US012110045B1

(12) United States Patent
Greenbaum et al.

(10) Patent No.: US 12,110,045 B1
(45) Date of Patent: Oct. 8, 2024

(54) RAILWAY SWITCH MANAGEMENT SYSTEM AND/OR METHOD

(71) Applicant: Parallel Systems, Inc., Los Angeles, CA (US)

(72) Inventors: Marc Greenbaum, Los Angeles, CA (US); Andrea Anez, Los Angeles, CA (US); Patrick Dunn, Los Angeles, CA (US)

(73) Assignee: Parallel Systems, Inc., Los Angeles, CA (US)

( * ) Notice: Subject to any disclaimer, the term of this patent is extended or adjusted under 35 U.S.C. 154(b) by 0 days.

(21) Appl. No.: 18/672,864

(22) Filed: May 23, 2024

Related U.S. Application Data

(60) Provisional application No. 63/521,311, filed on Jun. 15, 2023.

(51) Int. Cl.
*B61L 11/08* (2006.01)
*B61L 1/18* (2006.01)

(52) U.S. Cl.
CPC ..... *B61L 11/08* (2013.01); *B61L 1/181* (2013.01); *B61L 2011/086* (2013.01)

(58) Field of Classification Search
CPC ..... G01W 1/14; G01W 1/06
USPC ..... 701/19
See application file for complete search history.

(56) References Cited

U.S. PATENT DOCUMENTS 3,848,533 A * 11/1974 Grow ..... B61K 1/00 104/18
11,305,796 B1 4/2022 Shue et al.
2004/0006413 A1 1/2004 Kane et al.
2009/0184211 A1 7/2009 Groves et al.
2012/0203419 A1 8/2012 Tucker et al.
2016/0368495 A1 12/2016 Luther et al.
2016/0375888 A1 12/2016 Allwardt
2017/0108876 A1 4/2017 Mullan et al.
2017/0320507 A1 11/2017 Denny et al.
2018/0079436 A1 * 3/2018 Fifield ..... B61L 27/40
2018/0231972 A1 8/2018 Woon et al.
2018/0339719 A1 11/2018 Loughlin
(Continued)

FOREIGN PATENT DOCUMENTS

CA 3074977 A1 * 10/2020 ..... B61L 25/021
JP 6851278 B2 3/2021
(Continued)

OTHER PUBLICATIONS

Dunn, Patrick , et al., "Rail Authority System and/or Method", U.S. Appl. No. 18/373,225, filed Sep. 26, 2023.
Dunn, Patrick , et al., "Rail Control System and/or Method", U.S. Appl. No. 18/499,034, filed Oct. 31, 2023.
Dunn, Patrick , et al., "Remote Rail Monitoring System and/or Method", U.S. Appl. No. 18/776,069, filed Jul. 17, 2024.
(Continued)

*Primary Examiner* — Muhammad Shafi
(74) *Attorney, Agent, or Firm* — Jeffrey Schox; Diana Lin

(57) ABSTRACT

The system can include: a motion planner and a switch management system. The system can optionally include or operate in conjunction with a vehicle controller, a user interface (UI), and a track data system. However, the system 100 can additionally or alternatively include any other suitable set of components. The system functions to facilitate vehicle control and/or manage authority, in the form of exclusive track reservations, within a rail network. Additionally or alternatively, the system can function to manage switch positions (and/or operation based on switch positions) within a rail network.

20 Claims, 9 Drawing Sheets

(56) References Cited

U.S. PATENT DOCUMENTS

| | | | | |
|---|---|---|---|---|
| 2019/0054929 | A1* | 2/2019 | Yao | B61B 1/005 |
| 2019/0176862 | A1 | 6/2019 | Kumar et al. | |
| 2019/0281052 | A1 | 9/2019 | Lekkas | |
| 2019/0389498 | A1 | 12/2019 | Grimm et al. | |
| 2021/0094567 | A1 | 4/2021 | Imai et al. | |
| 2021/0094597 | A1* | 4/2021 | Rush | B61L 21/10 |
| 2021/0132625 | A1 | 5/2021 | Gillett | |
| 2021/0188332 | A1* | 6/2021 | Brooks | G05D 1/021 |
| 2021/0291883 | A1 | 9/2021 | Gotlund et al. | |
| 2022/0137623 | A1* | 5/2022 | Goyal | B60W 60/00274 701/23 |
| 2022/0185350 | A1 | 6/2022 | Kindt et al. | |

FOREIGN PATENT DOCUMENTS

| | | | | |
|---|---|---|---|---|
| WO | 2017211593 | A1 | 12/2017 | |
| WO | 2018026615 | A1 | 2/2018 | |
| WO | WO-2018054616 | A1 * | 3/2018 | B61L 21/04 |
| WO | 2022192795 | A2 | 9/2022 | |

OTHER PUBLICATIONS

Dunn, Patrick , et al., "System and/or Method for Remote Operation of a Rail Vehicle", U.S. Appl. No. 18/514,946, filed Nov. 20, 2023.

Fraga-Lamas, Paula , et al., "Towards the Internet of Smart Trains: A Review on Industrial IoT Connected Railways", Sensors, Jun. 21, 2017, URL: https://www.mdpi.com/1424-8220/17/6/1457.

Greenbaum, Marc , et al., "Railway Switch Management System and/or Method", U.S. Appl. No. 18/672,864, filed May 23, 2024.

Pendleton, Scott Drew, et al., "Perception, Planning, Control, and Coordination for Autonomous Vehicles", Google Scholar, M DPI Machines, Feb. 2017, pp. 1-54. (Year: 2017).

Sanaei , et al., "Interface for a Railway Control System", Chalmers University of Technology, Dec. 13, 2011, <URL: http://odr.chalmers.se/bitstreams/fcb1915c-254a-4c15-b364 66d99a4c2167/download>.

Singh, Prashant , "Deployment of Autonomous Trains in Rail Transportation: Current Trends and Existing Challenges", Google Scholar , IEEE Access, vol. 9, Jun. 2021, pp. 91427-91461. (Year: 2021).

* cited by examiner

RAILWAY SWITCH MANAGEMENT SYSTEM AND/OR METHOD

CROSS REFERENCE TO RELATED APPLICATIONS

This application claims the benefit of U.S. Provisional Application No. 63/521,311, filed 15 Jun. 2023, which is incorporated herein in its entirety by this reference.

This application is related to U.S. application Ser. No. 18/373,225, filed 26 Sep. 2023, U.S. application Ser. No. 18/499,034, filed 31 Oct. 2023, U.S. application Ser. No. 18/609,832, filed 19 Mar. 2024, U.S. application Ser. No. 18/514,946, filed 20 Nov. 2023, and U.S. application Ser. No. 18/635,008, filed 15 Apr. 2024, each of which is incorporated herein in its entirety by this reference.

TECHNICAL FIELD

This invention relates generally to the transportation field, and more specifically to a new and useful rail authority system and/or method in the transportation field.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. Overview

Figure 1:
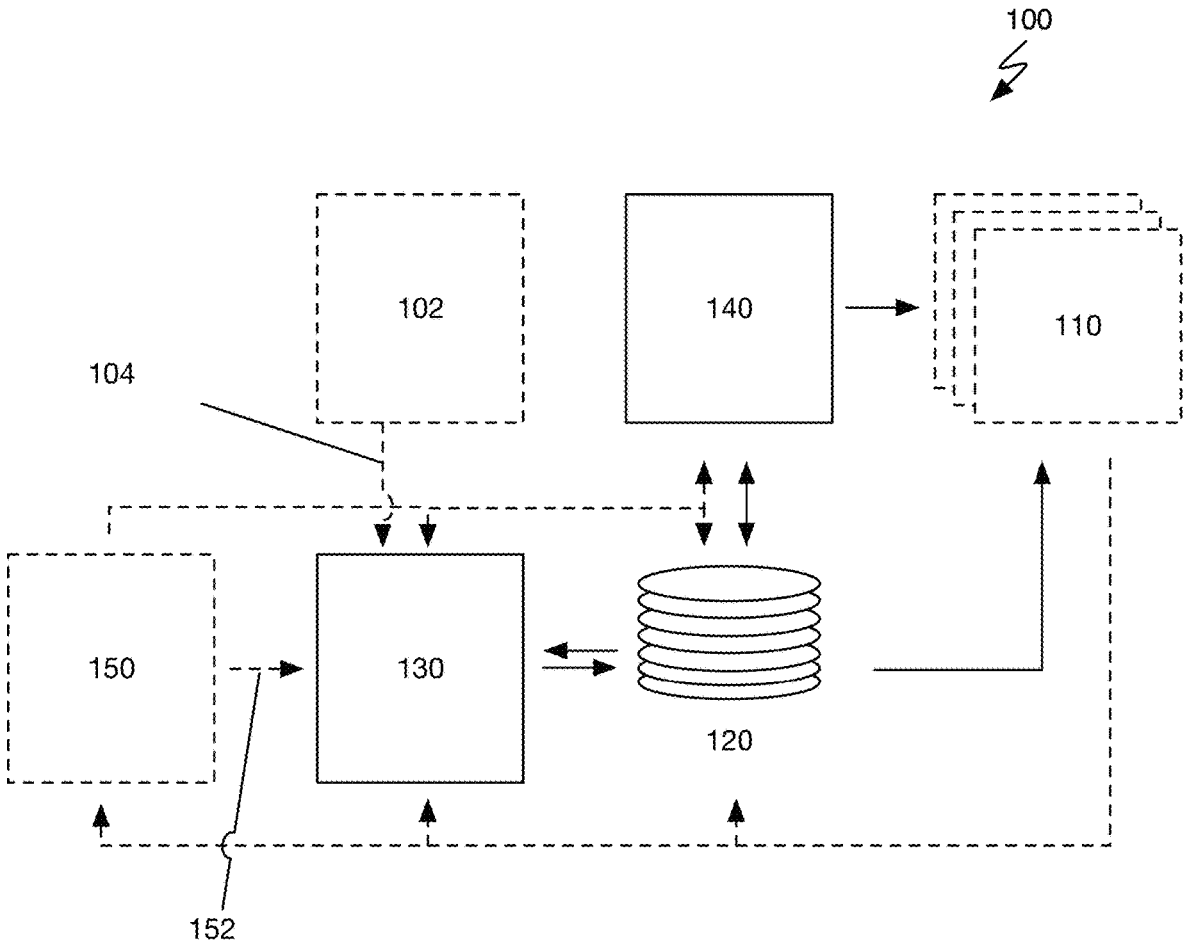
FIG. 1 is a schematic representation of a variant of the system.

The system 100, an example of which is shown in FIG. 1, can include: a motion planner 140 and a switch management system 130. The system can optionally include or operate in conjunction with a user interface (UI) 150, a data system 120, and a vehicle controller 110. However, the system 100 can additionally or alternatively include any other suitable set of components. The system functions to facilitate vehicle control and/or manage vehicle authority, in the form of (exclusive) track reservations, within a rail network. Additionally or alternatively, the system can function to manage switch positions, switch reservations, and/or operation based on switch positions (and/or reservations) within a rail network.

Figure 3:
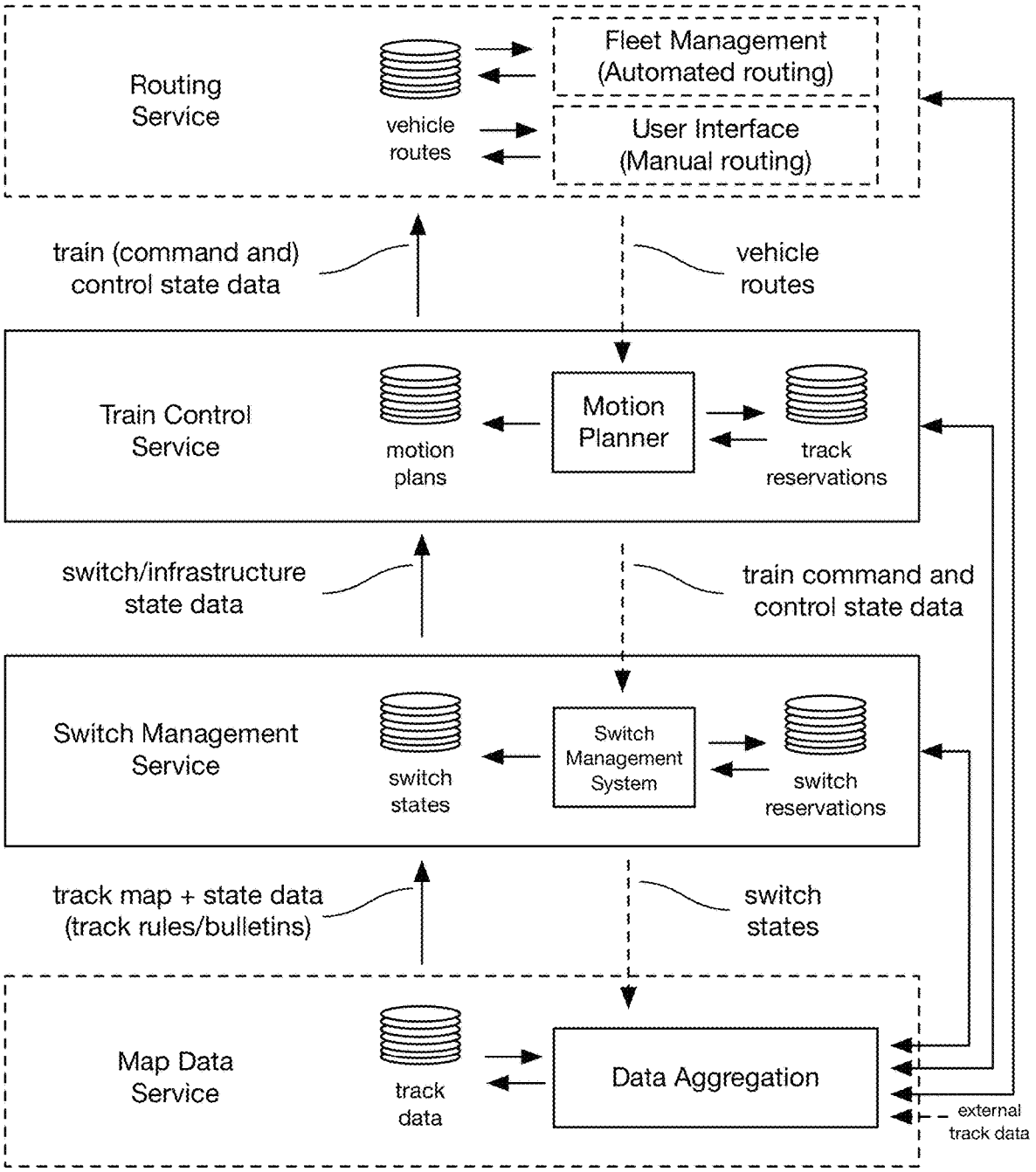
FIG. 3 is a schematic example of a service hierarchy in a variant of the system and/or method.

In variants, the system can provide consistent handling of unmonitored track via track rules (e.g., railroad switches default lined main-to-main), which can be predetermined and/or stored in a database for reference. For example, track rules can be stored and referenced in conjunction with a versioned track map and/or track data (e.g., track bulletins) therefor, such as may be received from a railroad authority or another external track data source. For instance, track data can be aggregated by a map data service, an example of which is shown in FIG. 3.

In variants, the system can facilitate a single operator (e.g., remote tele-operator) supervising a multitude of vehicles routed to move through the same set of switches. For example, the system can operate in conjunction with the tele-operation systems (and/or prioritization scheme [s]) as described in U.S. application Ser. No. 18/514,946, filed 20 Nov. 2023, titled "SYSTEM AND/OR METHOD FOR REMOTE OPERATION OF A RAIL VEHICLE," which is incorporated herein in its entirety by this reference.

The system can optionally include or be used in conjunction with a vehicle(s) which can traverse within a rail network according to the motion plan and/or commands associated therewith. Each vehicle(s) can include a vehicle controller and/or any other suitable elements. However, the vehicle can include any other suitable elements and/or can be otherwise configured.

In variants, the vehicle(s) can be as described in one or more of: U.S. application Ser. No. 17/694,499, filed 14 Mar. 2022, titled "ELECTRIC RAIL VEHICLE," U.S. application Ser. No. 17/335,732, filed 1 Jun. 2021, titled "ELECTRIC RAIL VEHICLE," each of which is incorporated herein in its entirety by this reference. In variants, the vehicle controller can facilitate vehicle control and/or platooning in accordance with the system and/or methods as described in U.S. application Ser. No. 17/732,143, filed 28 Apr. 2022, which is incorporated herein in its entirety by this reference. In a specific example, the vehicle controller can be the controller of a leading vehicle of a leading car of a platoon (e.g., wherein a remainder of vehicles and/or cars of the platoon are controlled based on the operation of the leading car).

The term "switch" as referenced herein preferably refers to a railroad switch (a.k.a., turnout), which can be used to guide railway vehicles from one track to another. For example, railway switches can include slip switches (e.g., single slip, double slip, outside slip, etc.), crossovers, stub switches, three-way switches, plate switches, interlaced turnouts, off-railers, wye switches, run-off points, rack switches, switch diamonds, single point switches, rotary switches, temporary points, and/or any other suitable switch (es). Switch states can be binary (e.g., main-to-main or turnout/siding) or nonbinary (e.g., multi-state; 3 states for a three-way switch; where 'unknown' may add an additional state for an otherwise-binary switch state; etc.). Additionally, the term "switch" may refer to a wayside asset and/or rail feature with multiple states (i.e., where the state may 'switch'), such as a signal, junction, crossing, switch, and/or any other suitable wayside asset associated with the track. In such variants, it is understood that the term "switch management system" may be interchangeable with the term "infrastructure management system," "wayside asset management system," or the like, and/or may be otherwise suitably used or referenced. However, the term "switch"

and/or switch management system" can be otherwise suitably used or referenced herein.

Switches and/or wayside assets can include: unmonitored systems, monitored systems (e.g., monitored switch; monitored by a track monitoring system [s]; etc.), manually adjustable/actuatable systems (e.g., locally; manual railroad switch), remotely actuatable/controllable systems (e.g., by a UI, etc.), and/or any other suitable type(s) of wayside assets.

The term "substantially" as utilized herein can mean: exactly, approximately, within a predetermined threshold or tolerance (e.g., 1%, 1%, 5%, 10%, 50%, etc.), and/or have any other suitable meaning.

1.1 Examples

Figure 5:
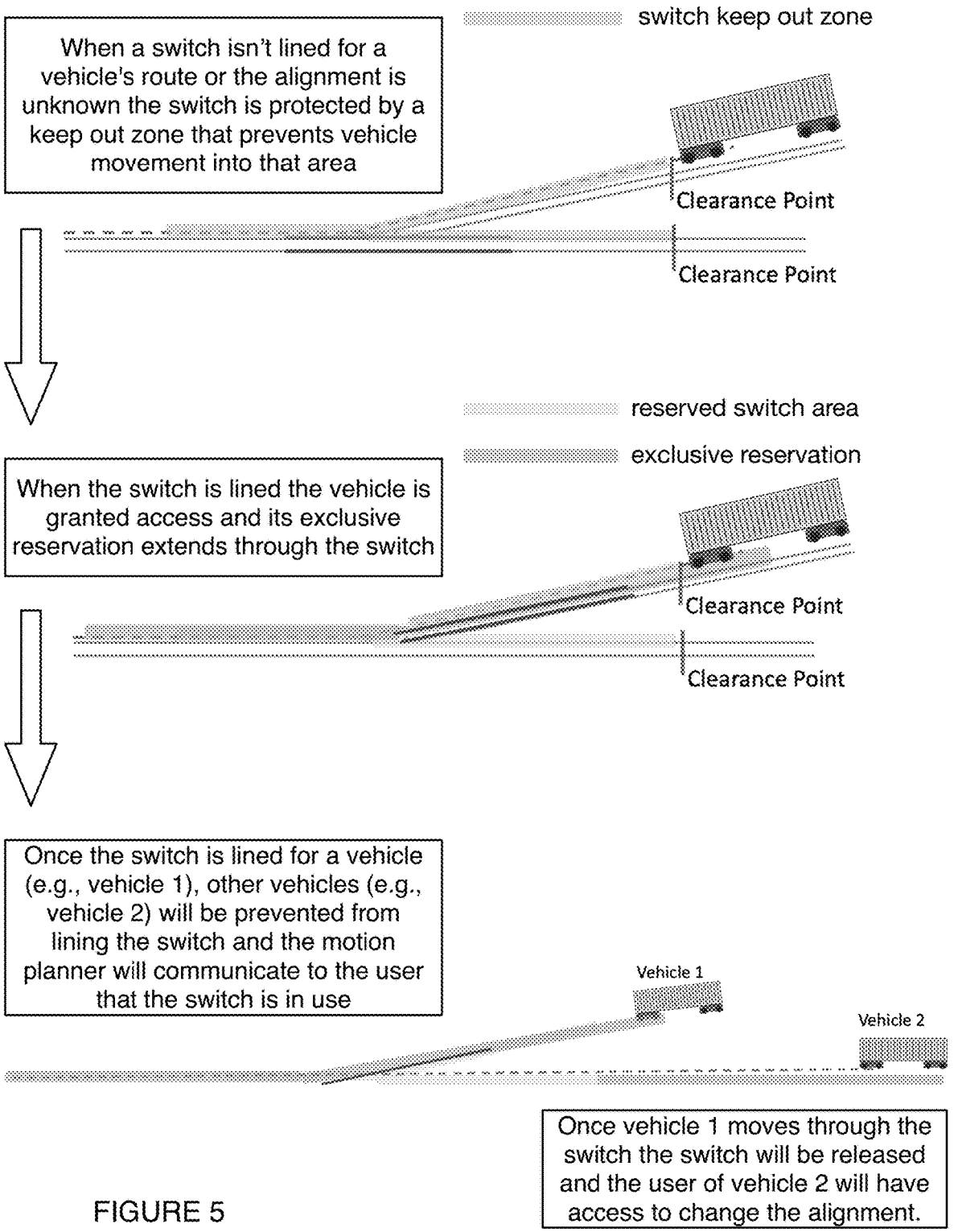
FIG. 5 is a diagrammatic illustration of track reservations and vehicle movement around a switch in a variant of the system and/or method.

In one set of variants, an example of which is shown in FIG. 5, a switch within a rail network can be protected by a keep-out-zone which restricts vehicles from moving through the adjacent track unless the switch is lined for the (planned) vehicle route. When the switch is lined to the vehicle route, the vehicle can be granted an exclusive track reservation extending along the route, through the switch, to facilitate positive train control (PTC). In addition to the exclusive track reservation, which prevents vehicle interference, the switch can be reserved for the vehicle/route, locking the switch state to prevent users and/or other systems from modifying the switch position (e.g., to prevent interference with the switch on the behalf of any other vehicle, routes, users, etc.) until the switch reservation has been vacated and the vehicle has cleared the switch. Once the vehicle has vacated the switch reservation, the switch alignment can be changed to allow access for other vehicles and/or the switch alignment can be returned to a default state in accordance with a set of predetermined track rules. A switch management system can govern adjustments/changes to switch states (e.g., in accordance with track rules), and a motion planner can direct vehicles through the network (and/or request switch adjustments via the switch management system) based on the switch states.

Switch reservations and track reservations can be managed independently, by the switch management system and motion planner, respectively, for observations of the (distinct) track rules/policies which may apply to switches and vehicles. As an example, the switch reservations can be nonexclusive (e.g., multiple trains may reserve a single switch, which may be particularly advantageous in cases where two or three trains in a row are following a similar vehicle route), while track reservations may be exclusive per PTC rules (i.e., no two vehicles may occupy the same region of track to avoid collisions; this rule may be mandated throughout the rail network). Additionally, switch states may, in some cases, be inferred from track rules. For example, track rules may require that switches remain in a default (main-to-main) alignment except when reserved for a vehicle(s) being routed to a siding. Accordingly, unmonitored switch states may be inferred, for switch state management, from track rules and/or may be automatically reverted to the default belief state in the data system (e.g., even without direct observation or affirmative inputs by a user, where this is a predetermined track requirement). Additionally or alternatively, switch states (for unreserved switches) can be determined based on tele-operator inputs (e.g., manual analysis of camera images of the track; from a vehicle camera feed and/or wayside camera equipment), local operator inputs (e.g., via an API and/or UI), track monitoring systems (e.g., automatically based on inputs from a monitored switch; based on autonomous computer vision analysis of camera images, etc.), and/or with any other suitable input(s)/endpoint(s).

2. Benefits

Variations of the technology can afford several benefits and/or advantages.

First, variations of this technology can maintain persistent awareness and/or control of dispatched autonomous vehicles (AVs) and switches within a rail network, without persistent (or comprehensive) switch monitoring, which may dramatically reduce the infrastructure costs and integration burden for AV deployment. For example, the infrastructure cost of a single monitored switch in a rail network, which self-reports the position/status of the switch, may be upwards of $200,000; and rail AVs may traverse many switches (e.g., dozens) during a single mission. In particular, variants of the technology can allow a small number of human operators (e.g., one) to facilitate efficient traversal of a plurality (e.g., dozens) of vehicles in a rail yard with multiple (e.g., dozens of) unmonitored switches.

Second, variations of the technology can facilitate AV traversal across unmonitored switches in a rail network while providing robustness to handle various exceptions (e.g., unknown switch state, misaligned switches, etc.). For example, variants can provide exclusive (vehicle) reservations which limit access to the switch to a single vehicle (or a train/platoon of vehicles operating under a single reservation), which may only be provided after the switch position has been verified (e.g., by a user).

Figure 10:
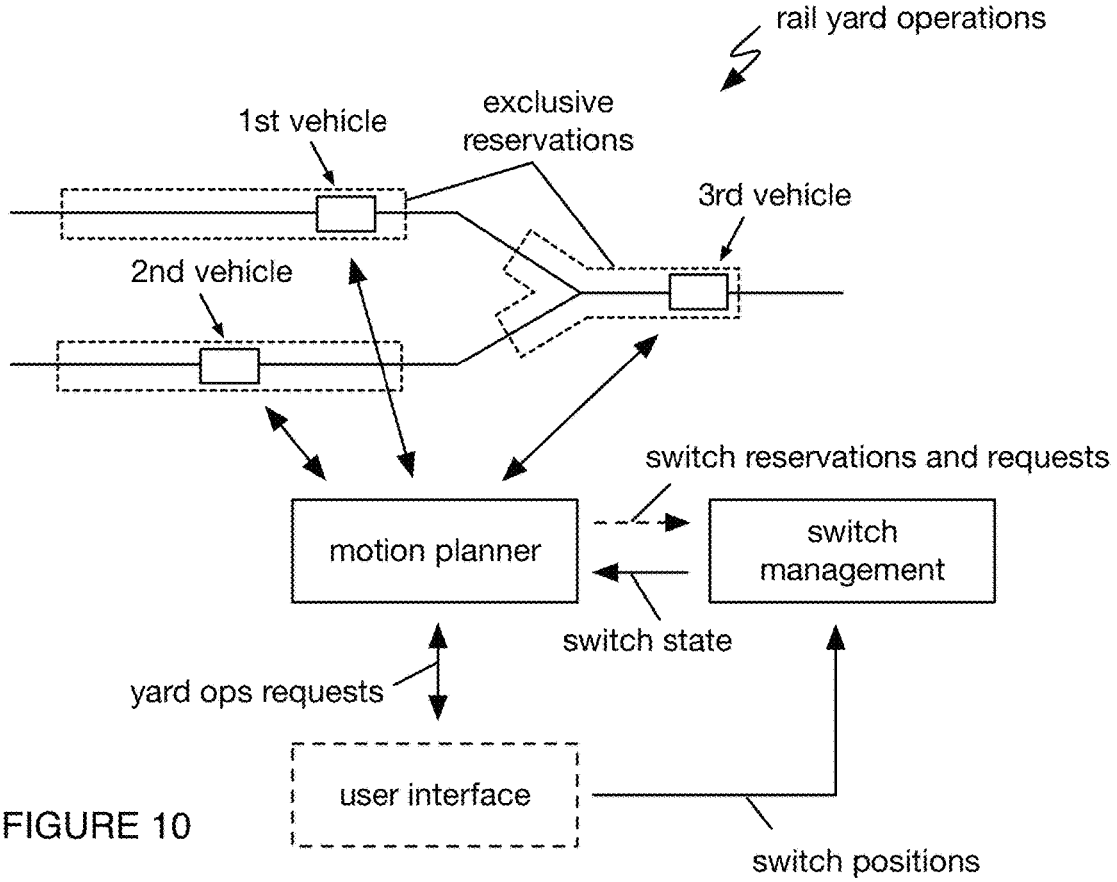
FIG. 10 is a diagrammatic representation of a variant of the system.

Third, variations of this technology can reduce and/or mitigate potential for vehicle collisions within a rail yard during separate and/or contemporaneous control of a plurality of rail vehicles within the rail yard (e.g., an example is shown in FIG. 10). For example, variants can facilitate positive train control (PTC) in conjunction with (and/or dependent on) switch position management, governing persistent switch state awareness for both switches and vehicles in accordance with track rules.

Fourth, variations of this technology may improve the efficiency of vehicle routing within a network by managing traversal of a vehicle(s) across a switch (e.g., based on switch position changes) and/or may reduce the time and effort required for a user to divert a vehicle(s) from a main line track onto a siding (or vice versa). For example, the process of diverting a conventional train to a siding is often more than 30 minutes, since the train engineer walks the full length of the train twice to return the switch to its previous state before proceeding (e.g., for a 1-mile-long train, the train engineer may be required to walk more than 2 miles; the engineer may be required to line the switch main to main). In contrast, an AV operator/user can flip the switch and confirm the switch state to allow the AV to proceed (e.g., which may take less than 1 minute and is not substantially impacted by the length of the train/platoon), and then return the switch to its previous state after the AV has passed (e.g., the switch can be reserved for a train [s] until the train [s] have vacated the switch clearance points and/or the train no longer holds an exclusive track reservation over the track segments between switch clearance points). This approach may dramatically reduce the time required to divert rail vehicles to a siding and/or may enable greater effective utilization of track(s) within a network, thereby increasing the overall network efficiency. Additionally, such variants can facilitate greater efficiency of fleet management and/or vehicle routing based on the switch position(s)/reservation (s) maintained by a switch management system.

However, variations of the technology can additionally or alternately provide any other suitable benefits and/or advantages.

3. System

The system 100, an example of which is shown in FIG. 1, can include: a motion planner 140 and a switch management system 130. The system can optionally include or operate in conjunction with a user interface (UI) 150, a data system 120, and a vehicle controller 110. However, the system 100 can additionally or alternatively include any other suitable set of components. The system functions to facilitate vehicle control and/or manage vehicle authority, in the form of (exclusive) track reservations, within a rail network. Additionally or alternatively, the system can function to manage switch positions, reservations, and/or operation based on switch positions within a rail network. An example of switch management is shown in FIG. 5.

3.1 User Interface

The user interface [UI] functions to facilitate manual vehicle routing and/or instruction/command of vehicles (e.g., in a yard operations context). Additionally or alternatively, the user interface can function to facilitate teleoperation (e.g., in a restricted speed context), manual updates to track map data (e.g., manual determinations of switch state for unmonitored switches, etc.), manual exception handling, manual operation of track infrastructure (i.e., manual switch state changes and/or state inputs), and/or other manual interventions/inputs. The user interface can be communicatively connected to the motion planner system, the track data system/service, the switch management system, and/or any other suitable data endpoints to provide manual navigation/routing instructions to facilitate for vehicle command, dispatch, and/or control. Additionally, user inputs via the user interface can be used to update the track data (e.g., based on manual bulletin inputs, manual switch state inputs, etc.; within the track data system and/or a map service thereof). In a specific example, user input provisions via the UI can be used by the switch management system to maintain a persistent belief state for the switches within the rail network. Additionally, the UI can surface feedback to a user(s) based on data aggregated from other systems/endpoints of the system (e.g., an example is shown in FIG. 3). The UI can surface feedback which can include: aggregated track data (e.g., managed by map service), vehicle routes (e.g., determined by manual routing and/or a fleet management system) track reservations (e.g., governed by motion planner), switch reservations (e.g., governed by the switch management system), vehicle state data (e.g., based on data received from vehicle controller), switch state data (e.g., determined by the switch management system), map service data (e.g., track map, state data, track rules, bulletins, feature waypoints, etc.; an example is shown in FIG. 3), and/or any other suitable data.

Figure 2:
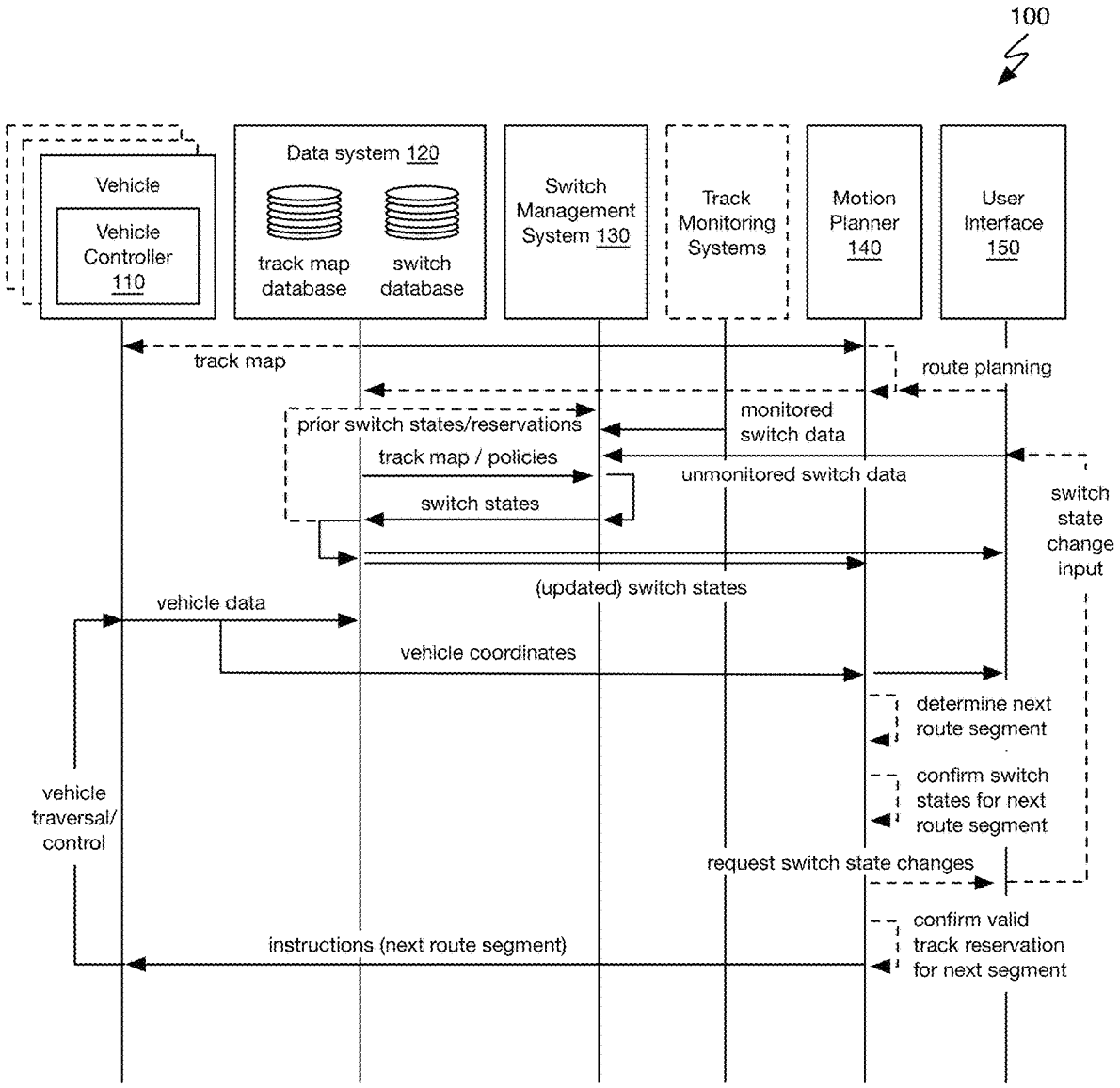
FIG. 2 is a flowchart diagram of a variant of switch management for a variant of the system and/or method.

In some variants, such as in a yard operation context, user inputs received via the UI can be used to generate vehicle routing instructions (e.g., an example is shown in FIG. 2) and/or (navigation) commands, which can be used to indirectly control a vehicle(s). For example, users can provide waypoints-based routing commands to the motion planner (e.g., via an API), which can be used to control the vehicle(s) in by the system(s) and/or method(s) as described in U.S. application Ser. No. 18/499,034 filed 31 Oct. 2023, titled "RAIL CONTROL SYSTEM AND/OR METHOD," which is incorporated herein in its entirety by this reference. In variants, the UI may facilitate manual provisions of waypoint-based commands via selection of waypoints (e.g., automatically generated waypoints) in an overlayed satellite image, aerial image, GPS referenced map, and/or another suitable interface. For instance, the UI may facilitate waypoint selection via a web application, API, mobile device (e.g., tablet or other wireless/cellular device), and/or any other suitable device(s)/service(s). In a first example, a yard operator (e.g., in proximity to a train/vehicle) may select predetermined waypoints (e.g., associated with predefined track features; automatically generated from named/mapped track features) via a first device which is communicatively coupled (e.g., wirelessly, by data aggregation service) to the motion planner, such as via a web app and/or API. As a second example, a remote operator may select waypoints via a remote (tele-) operator platform. As a third example, users may select automatically generated waypoints for named track features based on a (semantic) track feature name (e.g., or other index/ID), allowing the user to select the (predefined) geocoordinate waypoint (e.g., without needing to directly input specific coordinates). For instance, a user may select semantic names for a series of switches (and/or clearance points, switch legs, junctions, etc.) to manually generate and assign a route for a particular vehicle. As a fourth example, users may select waypoints to route a vehicle through a series of indexed track switches. However, the UI may otherwise facilitate selection/provision of waypoints. The waypoints can be separately maintained in a waypoint database, managed as a part of the track data service, generated using data from an external database(s) (e.g., a satellite map of Earth; a railroad authority map; etc.), and/or can be otherwise determined. In a first variant, waypoints can be predetermined and/or automatically determined based on the locations of track features. Alternatively, the UI may be used to manually define waypoints (e.g., relative to an aerial image, etc.), and/or may define positions/distances relative to waypoints (or associated track features).

The user interface can be used to determine and/or validate switch states (a.k.a., switch positions) to enable vehicle movement in conjunction with vehicle routing and train control. Additionally, the user interface can direct manual actions to change the state of a switch (e.g., based on existing vehicle routes and/or track rules). For example, users can be notified via the UI of a train approaching a switch (e.g., notification triggered based on the vehicle state, such as when the vehicle is about 0.25 miles away from the switch clearance point or about 1 minute away given the current motion plan), and request that the user modify the switch state (e.g., change configuration from default to route the vehicle to a siding). The user can manually change the switch position and provides confirmation of the switch state change via the UI (e.g., the switch management system can then update the belief state of the switch and reserve the switch to restrict automated/manual modification of the state). Once the train has cleared the switch and a distal switch clearance point (and the reservation of the switch has been released by the switch management system), the user may be notified and/or the switch state may be modified by the user. For instance, the UI may direct the user to modify the switch state to a new target state. Additionally or alternatively, the user may return the switch to a default state, such as lining the switch main-to-main (e.g., which may be required by track rules), once the reservation(s) on the switch are released.

However, the system can include or be used with any other suitable user interface and/or can exclude a user interface.

3.2 Track Data

The system can include or be used with a track data system which functions to store and/or maintain track data to be used for routing, dispatch, and/or vehicle control. The track data maintained within the track data system can include: a waypoint database; a track geometry (e.g., including a map of track segments, each including an 'edge' extending between a pair of 'nodes'; versioned, such as with an instance identifier and/or timestamp associated with the most recent update; etc.), track features (e.g., track geometry, clearance points, grade crossings, switch states, signal states, bulletins locations, etc.), track conditions (e.g., work zones, SR/RS zones, etc.), and/or any other suitable track data. In an example, the track geometry can be defined by a set of named track features (e.g., mileposts, fractional mileposts, control points, clearance points, signals, switches, stations, terminal locations, crane locations, charger locations, garages, destinations of interest, features/coordinates associated with track rules, etc.), each associated with a geographic location (or 'node'), with track segments defined therebetween, along a linear 'edge' or path between the nodes. The track geometry can be represented as a graph (e.g., of locations/nodes connected by track segments), a map, and/or otherwise represented. The track geometry and/or track data can be predetermined, derived from 3rd party data/maps (e.g., railroad maps), received from a railroad authority, and/or can be otherwise determined/updated with any suitable timing/frequency. The motion planner and the vehicle controller can both access and/or locally store track data (e.g., versioned track geometry) for use in any suitable determination/control. Track data can be pushed to the motion planner and/or vehicle controller(s) and/or pulled from the track data system (e.g., by the motion planner and/or vehicle controller) with any suitable timing/frequency. In a specific example, track data pertaining to regions proximal to the vehicle (e.g., within an authority granting region; within a 50-mile radius; a rail yard map at a current location or at a planned destination; etc.) can be pushed to the vehicle controller with any suitable timing/frequency (e.g., as a part of a warrant provision and/or as a part of command provision; separately from provision of commands or authority grants/warrants; etc.). However, the system can otherwise operate with any other suitable track data system and/or track map(s), and/or can otherwise maintain track data knowledge/information sharing throughout the system.

In variants, waypoints (and/or waypoint database) and/or track features (e.g., switches and/or switch states associated therewith) can be entirely independent of the track geometry. For example, track features and/or waypoints associated therewith can be managed in an external database or map service (e.g., tagged locations in a satellite map of Earth, for example) which can be used to generate GPS references for user-selected waypoints. Alternatively, the waypoints can be maintained locally (e.g., managed in a local database using proprietary data collected and/or stored by a server), remotely, via cloud storage/processing, generated (algorithmically) during runtime (e.g., around proximal track features), and/or can be otherwise maintained/managed. Waypoints can be associated with track features (i.e., at least a portion of the waypoints may be associated with and/or defined relative to the Earth-relative position of a track feature), which can include: mileposts, fractional mileposts, control points, clearance points, signals, switches, stations, terminal locations, crane locations, charger locations, garage locations, destinations of interest, and/or any other suitable track features/coordinates associated with track rules. Waypoints can be defined with a GPS/GNSS coordinate position, an Earth-referenced cell (e.g., S2 cells, etc.), a geohash, and/or can be otherwise suitably defined. In variants, waypoints can be automatically generated from (i.e., defined based on the locations of) mapped track features (e.g., from a map service, external database, or separately managed database). As an example, waypoints can be automatically generated from track features in a map, which may allow users to select waypoints relative to (pre-) mapped track features without manually entering a coordinate position for the feature. Waypoints can be automatically generated from mapped track features during runtime (e.g., pulled from a database or map service in proximity to a relevant portion of track, allowing a user to select relevant track features as waypoints), periodically, in response to a pull request, and/or with any other suitable frequency/timing. Automatically generated waypoints can be determined in locations along the track based on system rules and track constraints (i.e., where a vehicle is able to stop). For example, waypoints can be generated in proximity to track features based on track rules, regulatory constraints, and/or system limitations/constraints. A single waypoint can be automatically generated for a track feature (e.g., at a milepost or charging station) and/or multiple waypoints can be automatically generated around a track feature (e.g., on either side of a crossing; on each leg of a switch; etc.). In a first example, waypoints can be automatically generated on the reverse, normal, and facing legs of switches (e.g., which are used as destinations to move the vehicle through the switch and as staging locations to park the vehicle before making a move through the switch; at clearance points which are offset by appropriate clearance distances/constraints on each leg, etc.). In a second example, waypoints can be automatically generated around crossings (e.g., at clearance points offset on either side of the crossing by an appropriate clearance; allowing either side of the crossing to be selected in order to move the vehicle through the crossing and as staging locations to stop the vehicle before making a move through the crossing).

However, the system can otherwise generate and/or manage waypoints, and/or the system can include or be used with any other suitable track data system and/or map service (s).

The track data system can include or operate in conjunction with the switch management system/service. For example, the track data system preferably indexes track coordinates and/or waypoint positions for each switch in the rail network. The switch management service (i.e., layered on top of the track map service, such as in a management hierarchy, an example of which is shown in FIG. 10) can manage the belief state for each switch in the rail network, along with the (current) switch reservations. Accordingly, switch management is preferably indexed globally and/or referenced against the feature waypoints (i.e., semantic waypoints, rather than tied to indices in a particular map version or set of track map coordinates). However, switch management can additionally or alternatively utilize track coordinates/indices associated with a particular map version, and/or can be otherwise managed. Similarly, switch states data and/or switch reservations can be independently managed by the switch management system and/or can be aggregated by the track data system/service and switch data can be pushed to (or pulled by) various endpoints in the system (e.g., in global waypoint coordinates and/or track map geometry).

However, track data can be otherwise suitably managed and/or stored in the system. Additionally or alternatively, databases for track data and/or data resources of the system (e.g., motion plans and/or track reservations managed by the motion planner; switch states and/or switch reservations managed by the switch management system; etc.) can be centralized, distributed, and/or otherwise stored/distributed between system elements. For example, a single database can aggregate: map data (e.g., track map along with track rules/bulletins), switch states, train command and control states (e.g., vehicle state data; vehicle commands and/or motion plans), vehicle routes, external data (e.g., received via an API; such as received from a railroad integration system), and/or any other suitable data (e.g., where individual systems/services manage updates to state data/parameters).

In variants, the system and/or track data system/service thereof can optionally include or be used in conjunction with a railroad integration system/service which functions to translate authority grants from a railroad authority (ies) into a movement authority (a.k.a., macro-warrant) which can be provided to the motion planner (a.k.a., vehicle dispatch system). Additionally or alternatively, the railroad integration system can transform protocol-specific authority grants, issued by a railroad authority, into a unified form (e.g., movement authority). Additionally or alternatively, the railroad integration system can be used to update mapped track data based on information received from the railroad authority (e.g., map updates, track condition updates, track feature updates, bulletin notifications, etc.). For example, map updates received from the railroad integration system and/or railroad authority (e.g., speed restrictions; bulletins; etc.) may be accessed/referenced by the switch management system prior to issuing new switch reservations and/or updating switch states. Additionally or alternatively, map updates may hold reservations for a subset of switches (e.g., with active track bulletins), which may prevent vehicles from being routed through said switches and/or updates to the switch state (e.g., restricting access to switches and/or changes to switch state; such as where switches are under construction/maintenance, for example).

The railroad integration system can receive a set of inputs from the railroad authority, which can include: track signals, authorization forms, track feature updates (i.e., changes to track geometry/features), track condition updates, track bulletins, and/or any other suitable information. The set of inputs is preferably received according to a predetermined protocol, specific to a particular railroad authority, but can be received in any suitable data format. In a specific example, the railroad integration service can include an API (specific to a particular railroad authority; generalized API which can interface with each railroad authority; etc.). Additionally or alternatively, the railroad integration service can be integrated into an API Gateway, can communicate with an API Gateway (e.g., allowing the railroad integration system and/or railroad authority to communicate with the track data system and/or map service such that the data can be accessed by switch management system and motion planner), and/or can be otherwise integrated with and/or interface with various components of the system.

The railroad integration system can determine a movement authority, or a (coarse) authority region of track, based on the inputs from the railroad authority. For example, the movement authority can be defined based on a starting and ending point along the track (e.g., coordinate point, in track map coordinates; relative to track nodes/features/segments, etc.) and can include a set of intervening track sections (e.g., relative to a track map). The inputs can be transformed into movement authorities based on a predetermined set of rules, transformations, and/or protocols (e.g., which can be railroad authority specific or railroad authority agnostic). Movement authorities can be determined as a one-to-one mapping of authority grants from a railroad into a track map reference frame, and/or can be further constrained based on a set of rules/heuristics. For example, movement authorities and/or constraints associated therewith may be used to delineate between 'autonomous' sections of track and 'teleoperation' sections of track (e.g., restricted speed sections, where the authority is only granted under may only under a condition of remote supervision). Similarly, movement authority constraints may establish track rules and/or policies governing switch positions (e.g., default switch position; etc.) and/or switch monitoring/validation (e.g., periodic verification/validation requirements, etc.).

In variants, movement authorities can additionally include a set of operating constraints which can be received from the railroad authority and/or another endpoint (e.g., user interface, fleet management system), and/or can be retrieved from a track data system. For example, the operating constraints can include a speed-constraints (e.g., speed limit), directional constraint (e.g., unidirectional movement constraint, bidirectional movement constraint, etc.), track restrictions (e.g., teleoperation track segments, advisory bulletin restrictions, etc.), time constraints (e.g., expiration parameter associated with the movement authority, etc.), and/or any other suitable operational constraints. The railroad integration system can include processing and/or processing modules which can be: local, remote (e.g., at a remote server, at a third party server, cloud processing, etc.; an element of the remote systems), centralized, distributed, and/or processing for the railroad integration system can be otherwise executed. In variants, movement authorities can be updated by the railroad integration system periodically, aperiodically, in response to receipt of an updated authority grant from a railroad authority, and/or with any other suitable timing/frequency. Additionally or alternatively, movement authorities can be invariant/fixed until completed and/or vacated. In variants, movement authorities can be pushed to the various processing endpoints (e.g., motion planner and/or switch management system), such as in response to movement authority issuance, and/or pulled from data storage (e.g., cloud data service), such by the motion planner and/or switch management system. However, track data can be otherwise suitably determined and/or managed.

In variants, the system and/or data service thereof can optionally include or be used with a set of Application Program Interface (API) Gateways, by which external/user-facing system(s)/components(s) can interface with vehicle dispatch and track data systems/services (e.g., coupling the UI and/or Railroad Service to motion planning, switch management, fleet management, and/or data systems). For example, the API Gateway(s) can handle authorization, QoS, translation protocols, and/or any other suitable tasks/functionalities. As a second example, the user interface and/or switch management systems can be integrated into the API Gateway and/or can interface with the motion planner via an API Gateway(s). However, the system can be used with any other suitable API(s) and/or without an API Gateway(s) in various contexts.

3.3 Fleet Management

The system can optionally include or be used with a fleet management system which functions to direct routing and/or navigation of fleet resources (e.g., vehicles, cargo, etc.) throughout the vehicle network. Additionally or alternatively, the fleet management system can facilitate track authority requests/grants from a railroad authority (e.g., or a railroad authority integration service; assignment of individual vehicles to a command/request from a user). Additionally or alternatively, the fleet management system can determine vehicle routes/instructions based on user requests via the user interface, such as by the system(s) and/or methods as described in U.S. application Ser. No. 18/499,034, filed 31 Oct. 2023.

In some variants, the fleet management system can determine a vehicle to dispatch for a particular route, such as according to a set of rules, heuristics, decision logic (e.g., a decision tree, etc.), a neural network (e.g., weighted linear regression), and/or can otherwise select a vehicle for dispatch and/or optimize vehicle routing. For example, vehicles can be selected based on availability (e.g., not loaded with cargo), proximity to a target (e.g., distance, traversal time, number of intervening vehicles, etc.), vehicle state, state of charge, state of maintenance, and/or can be otherwise selected. Additionally or alternatively, commands can be manually associated with a particular vehicle (e.g., via UI inputs; where a user directs a particular vehicle to move to a particular location via the UI, for example) or can otherwise be determined upstream of the vehicle dispatch system. Alternatively, vehicle routes can be otherwise associated with a particular vehicle and/or not associated with a specific vehicle.

In some variants, the fleet management system can additionally or alternatively be used to determine (waypoint-based) routes based on navigational optimizations (e.g., based on the track map, existing warrants, switch reservations, and track reservations, etc.) for the fleet of vehicles within the rail network, and communicate the routes to the motion planner for dispatch and train control. The fleet management system can be integrated with the motion planner or can be separately managed (e.g., as a separate cloud service, via separate processing, etc.).

In variants, a fleet management system can be configured to optimize vehicle routes, comprising a respective series of switches, for vehicles within the rail network (e.g., provided to the motion planner for train control and route execution; wherein the series of switches is referenced by the motion planner to determine switch reservations based on the switch states).

However, the system can include or be used with any other fleet management system and/or can exclude a fleet management system; for example, vehicle routes can be manually determined and provided via the user interface (e.g., in absence of fleet level optimizations) for motion planning and train control.

3.4 Motion Planner

Figure 8A:
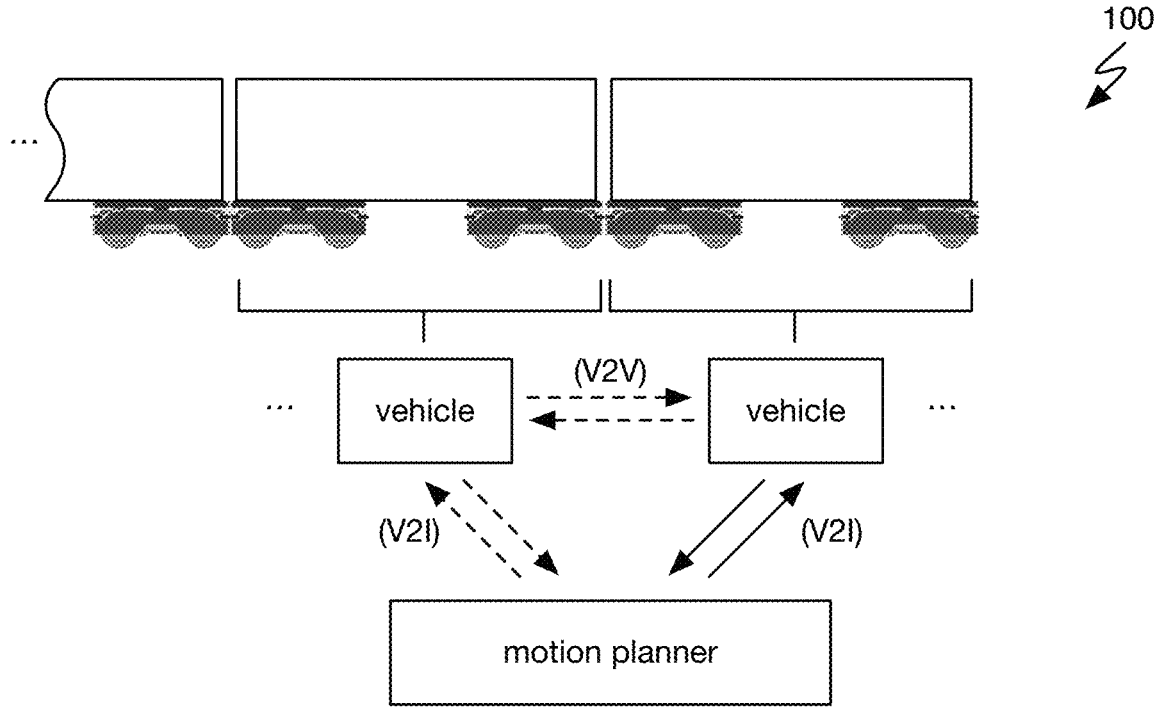
FIG. 8A is a diagrammatic representation of a variant of the system.
Figure 8B:
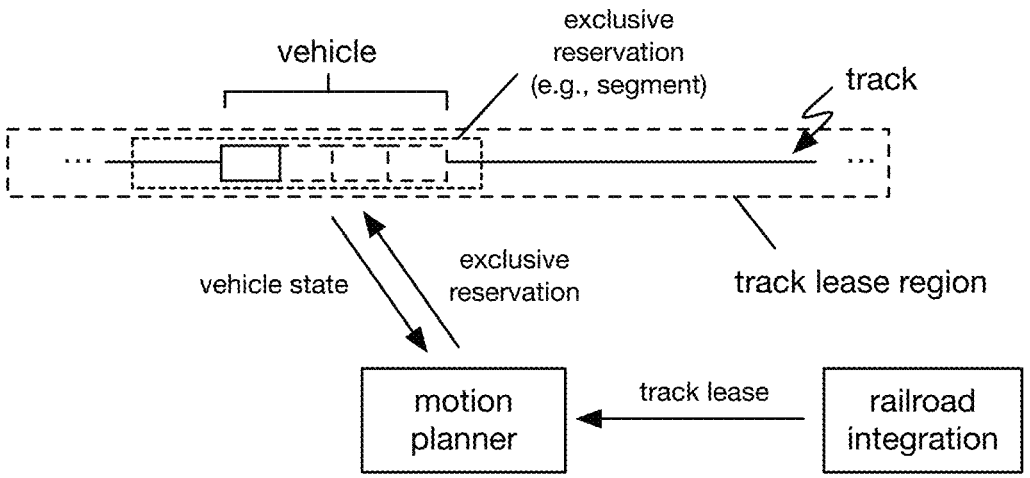
FIG. 8B is a diagrammatic representation of a variant of the system.

The motion planner (a.k.a., vehicle dispatch system) functions to direct traversal and/or dispatch of a set of vehicles within the rail network (e.g., examples are shown in FIG. 8A and FIG. 8B). Additionally or alternatively, the motion planner can function to impose motion constraints on vehicles within the rail network (e.g., limiting traversal through switches with known positions which align to the planned route/track). Additionally or alternatively, the motion planner functions to determine a set of (exclusive) track reservations which (granularly) direct vehicle operation throughout the rail network and/or implement Positive Train Control (PTC) protections/limits (e.g., along a particular vehicle route). Additionally or alternatively, the motion planner can function to maintain state awareness for vehicles (i.e., vehicle positions) throughout the rail network.

The motion planner determines exclusive reservations (a.k.a., micro-warrants) for each of the set of vehicles and/or vehicle controllers thereof operating within the rail network. In a first example, the motion planner can determine a respective reservation for each train (and/or platoon) within the rail network (e.g., an example is shown in FIG. 10). In a second example, the motion planner can determine a respective reservation for a single vehicle within the rail network, such as a single electric vehicle/bogie as described in U.S. application Ser. No. 17/694,499, filed 14 Mar. 2022, and/or U.S. application Ser. No. 17/335,732, filed 1 Jun. 2021, each of which is incorporated herein in its entirety by this reference. In a third example, the motion planner can provide exclusive reservations to a switch and/or a keep out zone associated therewith (e.g., preventing vehicles/platoons from simultaneously directing/controlling the switch state and/or occupying the switch).

The exclusive reservations can include: a (granular) track region (e.g., a subset of the larger warrant issued by a railroad authority which grants movement authority along the track; a subset of a route; a list of track segments referenced to map; track boundary constraints; a track segment including switch and/or surrounding keep out zone, such as between a set of clearance points; etc.), a set of operational parameters (e.g., target speed, speed limit, traversal direction), an expiration parameter (e.g., duration of proceed authority), a track condition parameter (e.g., checksum, validation parameter, etc.), a heartbeat parameter/signal, switch position data (e.g., from the switch management system), and/or any other suitable parameters/information. For example, an exclusive reservation can include a (granular) track region corresponding to a switch and a set of adjacent track segments (e.g., between a set of clearance points, within a threshold distance of the switch, such as within 10 meters, 100 meters, etc.; within a switch keep out zone, etc.).

In some variants, the exclusive reservations can include or be associated with a heartbeat parameter (or heartbeat mechanism/signal). For example, the reservations itself and/or a command associated therewith, may serve as a heartbeat mechanism where the vehicle and/or a vehicle controller thereof is limited in its ability to autonomously/independently proceed by the (granular) authority grant/command associated with the exclusive reservation. Thus, the vehicle may require receipt of periodic heartbeat signals (i.e., commands) in order to continue smoothly, without stopping. For instance, in the event of a communication failure and/or divergence in a track condition checksum for a reservation (e.g., n+1 reservation issued to a particular vehicle), the vehicle may be limited by the constraints of a prior (e.g., n) reservation and/or command. In absence of communication between the motion planner and the vehicle controller (e.g., at time n+1, n+2, etc.), the motion planner may rely on the prior (e.g., n) reservation and/or constraints thereof to maintain granular awareness of the location of the vehicle (e.g., which may facilitate persistent collision avoidance throughout the rail network and/or granular state estimation for the purpose to fleet management, switch state management, and/or vehicle command generation). Alternatively, the reservations can include or be used in conjunction with a separate heartbeat parameter/signal, which may be issued with the same timing/frequency as the reservations or a different timing/frequency.

The motion planner can issue exclusive reservations and/or provide exclusive reservations to vehicles (e.g., via wireless communication, such as an LTE connection): periodically, aperiodically, in response to a change in switch state (e.g., of an adjacent switch), in response to a track map update (e.g., change in track condition, issued bulletin, track geometry change, state change, etc.), in response to a warrant update from a railroad authority (e.g., based on and/or with any other suitable timing/frequency), in response to receipt of an updated vehicle state (e.g., from the vehicle controller), and/or with any other suitable timing/frequency. More preferably, the motion planner can issue exclusive reservations with at least a predetermined minimum frequency (e.g., corresponding to a heartbeat parameter/signal). For example, the exclusive reservations can function as a heartbeat signal and can be issued periodically (e.g., every 10 seconds, every 20 seconds, etc.).

Exclusive reservations can include a (granular) region of track (e.g., defined in a track coordinate frame for a particular map version) and/or operational parameters which can be determined based on vehicle commands which direct vehicle routing and/or traversal within the rail network. Vehicle commands can be predetermined (e.g., for a train running a fixed schedule), received from a fleet management system, manually determined by a human operator (e.g., commanding vehicle operation within a rail yard; operation requests determined and/or selected via the user interface), and/or otherwise determined. Commands can be assigned/directed to a particular vehicle and/or a vehicle identifier associated with a vehicle controller of the vehicle. For example, a command can be associated with a navigation and traversal of a train between an initial location and a destination. Alternatively, vehicle commands can be unassigned, undirected, vehicle indiscriminate, and/or can be any other suitable commands.

In variants, the motion planner automatically determine exclusive reservations based on: the vehicle routing instructions (e.g., routing commands received from a fleet management system, a user interface, a tele-operation platform, etc.), extant macro-warrant(s) (e.g., received from the railroad integration system), the vehicle state (e.g., received from the vehicle controller to which the exclusive reservation will be granted/assigned), track conditions (e.g., received/retrieved track map data), the reservation update frequency, other vehicles' states, platoon parameters (e.g., number of vehicles in a platoon, platoon weight, etc.), and/or any other suitable information. In a first example, the track region of a reservation can be automatically determined contemporaneously and/or synchronously with (autonomous) operation/control of the respective vehicle (e.g., by the vehicle controller) to facilitate continuous and/or unencumbered operation of the respective vehicle under nominal conditions (e.g., absent emergent scenarios, absent proximal changes to track conditions, etc.). For instance, the motion planner can sequentially determine exclusive reservations spanning adjacent portions of track which collectively grant the vehicle authority to maintain a substantially continuous speed (e.g., 30 mph) while traversing a track region which exceeds the bounds of an initial reservation of the sequence. The exclusive reservation can be: calculated, looked up, determined using a set of heuristics, predicted (e.g., using a trained neural network), predetermined, randomly determined, manually determined, and/or otherwise determined. The exclusive reservations generated from the same warrant can have the same or different parameters (e.g., track region, duration, velocity permissions, switch state requirements, etc.).

In some variants, the motion planner can determine/grant a single exclusive reservation within a warrant or a plurality of exclusive reservations per warrant (e.g., which may facilitate platoon formation, such as described in U.S. application Ser. No. 17/732,143, filed 28 Apr. 2022, which is incorporated herein in its entirety by this reference). Exclusive reservations grants can be maintained indefinitely (e.g., while the vehicle occupies the corresponding region of track), can expire based on an expiration condition (e.g., in response to a determination of a superseding/replacement reservation at a subsequent time, in response to satisfaction of an expiration condition associated with an expiration parameter, in response to vehicle egress from the corresponding track region, etc.), and/or can be otherwise managed. In a first example, an exclusive reservation can be superseded by a subsequent reservation associated with the same vehicle (e.g., vehicle controller and/or vehicle identifier). Alternatively, exclusive reservations can remain active/valid until a vehicle vacates the reserved (exclusive) region of track (e.g., confirms operation under a subsequent reservation and/or communicates a release the reservation and/or reserved region of track) and/or can be otherwise released/managed.

The motion planner preferably maintains exactly one active/valid reservation per vehicle, but can additionally or alternatively issue two active/valid reservations per vehicle (e.g., wherein the vehicle operates under exactly one reservation; wherein the $n^{th}$ reservation is superseded by the $n+1^{th}$ reservation in response to a subsequent heartbeat confirmation, but both remain valid in absence of the heartbeat signal to accommodate asynchronous operation of the vehicle and motion planner), a plurality of reservations per vehicle (e.g., each corresponding to a respective expiration parameter), and/or any other suitable number of exclusive reservations per vehicle and/or vehicle controller. In one example, an exclusive reservation can be issued to the lead vehicle at a forward end of a platoon. In a second example, an exclusive reservation can be communicated to a plurality of vehicle controllers within a platoon (e.g., at a lead vehicle of each car, each vehicle controller, etc.; where each vehicle controller is individually constrained to operate within the reserved region of track). In a third example, reservations can be issued for the collective of vehicles within a platoon, but can additionally or alternatively be issued independently for each of a plurality of vehicles within the platoon (e.g., where each vehicle is individually limited by tighter constraints on the reservation, such as based on a relative position along the length of the platoon). However, (exclusive) reservations can be otherwise suitably granted and/or managed.

The motion planner can include processing and/or processing modules which can be: local, remote (e.g., at a remote server, at a third party server, cloud processing, etc.), centralized (e.g., centralized for a particular geographic region and/or region of rail network), distributed, and/or processing for the motion planner can be otherwise executed. In a specific example, motion planning can be regional and/or a set of regional motion planners can each govern reservation issuance over a respective track region. In variants, the motion planner and the set of vehicles (and/or vehicle controllers thereof) within the network preferably operate contemporaneously and/or synchronously, where the motion planner can issue exclusive reservations asynchronously to individual vehicles of the set (e.g., facilitating asynchronous state management of the vehicles within the network).

However, the motion planner(s) and/or vehicle dispatch systems can otherwise facilitate motion planning, vehicle dispatch, and/or vehicle routing.

At switches and the immediately adjacent region(s) of surrounding track (e.g., between a set of clearance points; switch keep out zone; an example is shown in FIG. 5), the motion planner preferably grants exclusive track reservations at least partially based on the switch state (e.g., managed/determined by the switch management system). For example, the motion planner may grant an exclusive track reservation which spans a switch (or grants access to track segment between a switch and switch clearance point) if the switch state matches the target state/configuration for the vehicle route and if it does not conflict with an existing track reservation(s). The track reservations granted by the motion planner preferably include the switch and/or a surrounding region of track (e.g., along all adjacent track segments), which may protect against vehicle collisions within a clearance region for the switch (i.e., a switch keep out zone) and may, in some variants, prevent changes to the switch state during the pendency of the reservation and/or until the reservation is released. Likewise, the motion planner may prevent vehicle motion through switches along the route by not granting a track reservation, such as in cases where the switch state is unknown, where the switch is not properly lined, and/or where an exclusive reservation for another vehicle already exists for the switch (and/or switch keep out zone thereof). However, the motion planner can otherwise grant exclusive track reservations around switches and/or otherwise prevent conflicts between vehicles at switch junctions or otherwise. Additionally or alternatively, track reservations (e.g., spanning a switch or otherwise) granted by the motion planner can be entirely decoupled from switch reservations (and/or independent of switch reservations) managed by the switch management system. For instance, a vehicle within a track reservation may retain exclusive agency over the reserved track region and, in some cases, it may be advantageous to divert a vehicle to a siding for repair/service (e.g., when stalled, out of power, etc.), which may occur by releasing the switch reservation while the train occupies a track reservation spanning the switch.

A user can issue an operations request to direct a vehicle (or set of vehicles) from a starting point to an ending point (e.g., via a specific path through the rail network; without a specific path; etc.), such as via a user interface. The operations request can be used to generate a set of vehicle commands at the motion planner to direct the vehicle in conjunction with a series of exclusive reservations. Where the path of the vehicle through the network traverses/crosses a switch, the vehicle commands correspond with a specific switch configuration (or target switch state).

Accordingly, the motion planner can query the switch database and/or switch data managed by the switch management system to determine if the switches are in the necessary state. The motion planner can query the switch management system: once (e.g., per heartbeat interval), repeatedly during execution of a command/mission, periodically/cyclically (e.g., once per cycle of the server; about once per second), in response to satisfaction of a predetermined condition (e.g., proximity trigger, temporal trigger, spatiotemporal trigger, event-based trigger, etc.), and/or with any other suitable frequency/timing. Based on the planned vehicle motion/commands, the motion planner can query updates to the switch state and/or request switch state changes via the switch management system and/or user interface/API (e.g., when the switch state is unknown and/or does not match the configuration required for the planned path). For example, an operator (e.g., on site, observing a camera feed, etc.) can provide a switch state for an unmonitored switch in the event the switch state is unknown, such as via a connected user device (e.g., phone/tablet) and/or may physically adjust the switch state to achieve the necessary configuration (e.g., an example is shown in FIG. 2).

However, the motion planner can otherwise query and/or interface with the switch management system.

3.5 Vehicle Controller

Each vehicle controller functions to control a vehicle within the rail network to facilitate operation of the vehicle based on the vehicle commands (e.g., issued by the motion planner) and/or dispatch instructions derived therefrom. More preferably, the vehicle controller functions to facilitate autonomous operation of the vehicle within a reservation (and/or reserved region of track associated therewith), based on the constraints of the reservation and/or the operational parameters of the reservation. For instance, the vehicle controller can facilitate autonomous operation of the vehicle within the track region using the versioned track geometry (e.g., for a waypoint-based route/motion plan). As an example, the vehicle controller may retain agency to stop within the track region based on perceived surroundings or internal diagnostics, but the movement/control of the vehicle controller may be directed and/or limited by the dispatch instructions (e.g., and/or static/dynamic constraints associated therewith; such as an authority region, speed constraints, logic gates, etc.). The vehicle commands may constrain: maximum speed, maximum proceed distance (e.g., movement boundaries), autonomy level (e.g., full autonomy, partial autonomy, human-in-the-loop control, etc.), direction of operation (e.g., unidirectional operation, bidirectional operation, etc.), proceed capability through a track feature (e.g., teleoperation and/or manual validation/verification may be required to advance through a switch of unknown state, for example) and/or can otherwise constrain vehicle operation.

Additionally, prior to executing the commands/instructions, the vehicle controller can validate the commands/instructions received from the motion planner (such as the track geometry or belief state for track features pertaining to the instruction; autonomous validation of a switch state). In a first example, commands and/or track-geometry-referenced coordinates thereof can be validated using a version identifier for the track map (e.g., stored locally at the vehicle in association with current track geometry version and/or received in association with a command; prior to execution), such as by way of a checksum or other validation protocol (e.g., hash function, etc.). In a second example, a belief state for a track feature associated with a command (e.g., target switch state) can be autonomously validated (e.g., by local vehicle perception, onboard the vehicle) before the vehicle proceeds across the switch; wherein the autonomous vehicle (and/or a tele-operator with granting proceed authority, such as through a speed restricted region) can retain agency to stop the vehicle before crossing a switch.

In variants, the vehicle controller can facilitate remote vehicle operation and/or remote validation of vehicle operations by any one or more of the systems and/or methods described in U.S. application Ser. No. 18/514,946, filed 20 Nov. 2023, titled "SYSTEM AND/OR METHOD FOR REMOTE OPERATION OF A RAIL VEHICLE," which is incorporated herein in its entirety by this reference. In a first example, the vehicle controller can facilitate remote (teleop) determination/validation of a switch state. In a second example, the vehicle controller can facilitate remote supervision of vehicle operation (e.g., through a speed restricted track region; as may be required under various track rules) and/or remote proceed authorization (e.g., based on a vehicle camera and/or video feed) to move across a switch. In such variants, the vehicles can wirelessly broadcast vehicle data to a cloud data system (e.g., via RTSP), which can create an endpoint accessible to remote infrastructure (e.g., a user interface and/or a tele-operation platform). Remote data systems/servers can then rewrite the RTSP stream as WebRTC, which may allow operators to toggle between vehicle data streams in real-time (or near real-time) via the UI. Additionally, vehicles can transmit (locally stored) vehicle data to remote infrastructure via any other suitable data connections (e.g., LAN, LTE data connection, cellular, Wi-Fi, Bluetooth, etc.), which may allow larger data volumes to be offloaded/stored when a high bandwidth connection exists, which can enable subsequent (asynchronous) analysis or supervised model training based on larger data volumes. Data (e.g., video streams, commands, etc.) can be transferred using WebRTC, RTMP, TRSP, HLS, SRT, CAMP, a combination thereof, and/or any other suitable data transfer protocol. As an example, a WebRTC backend with selective forwarding units (e.g., an intermediary system, such as Janus) may facilitate communication between the vehicle, motion planner, and/or UI such that the remote systems do not directly communicate with the vehicle (e.g., and/or video feed). For example, an intermediary behind the RTC application may facilitate high-bandwidth, multi-stream routing (e.g., particularly as the number of vehicles, video streams, and UI endpoints is scaled), selectively forwarding data and/or video streams (e.g., from vehicles to the UI endpoints) as desired. Similarly, the UI may be communicatively decoupled from the vehicle, and instead indirectly control the vehicle via the motion planner (e.g., which may further limit proceed authorization based on extant track reservations, track rules, etc.; which may periodically broadcast motion planning updates and/or commands to the vehicle [s] and verify communication integrity). However, the vehicle can be otherwise suitably communicatively connected via any wireless network(s).

In variants, the vehicle controller can facilitate vehicle control and/or platooning in accordance with the system and/or methods as described in U.S. application Ser. No. 17/732,143, filed 28 Apr. 2022, which is incorporated herein in its entirety by this reference. In a specific example, the vehicle controller can be the controller of a leading vehicle of a leading car of a platoon (e.g., wherein a remainder of vehicles and/or cars of the platoon are controlled based on the operation of the leading car).

The vehicle controller preferably determines a vehicle state (a.k.a., vehicle status) and communicates the vehicle state to the motion planner (e.g., which can be used for validation, verification, and/or subsequent reservation determination). The vehicle state determined by the vehicle controller can include: speed estimation, battery characteristics (e.g., state of charge, state of health, state of power, etc.), heading, diagnostic parameters (e.g., battery characteristics, powertrain characteristics, sensor characteristics, etc.), perception performance (e.g., heading distance, etc.), brake performance estimates (e.g., max stopping distance), environmental representations (e.g., classification of objects/obstacles in the environment), and/or any other suitable vehicle state parameters/estimates.

Additionally, the vehicle controller can provide loop closure communicating (to the motion planner and/or data services) confirmation of updates to reservation assignment (e.g., confirming operation under an n+1 reservation), switch position (e.g., loop closure on belief state of a switch), track map updates (e.g., track condition parameter; via checksum), heartbeat parameters (e.g., central system connection parameters, warrant update parameters, etc.), and/or any other suitable information. In variants, if either the vehicle controller or the motion planner is unable to (asynchronously) validate communications and/or coordination relative to the track, the vehicle controller can control the vehicle to stop within the reservation.

Figure 6:
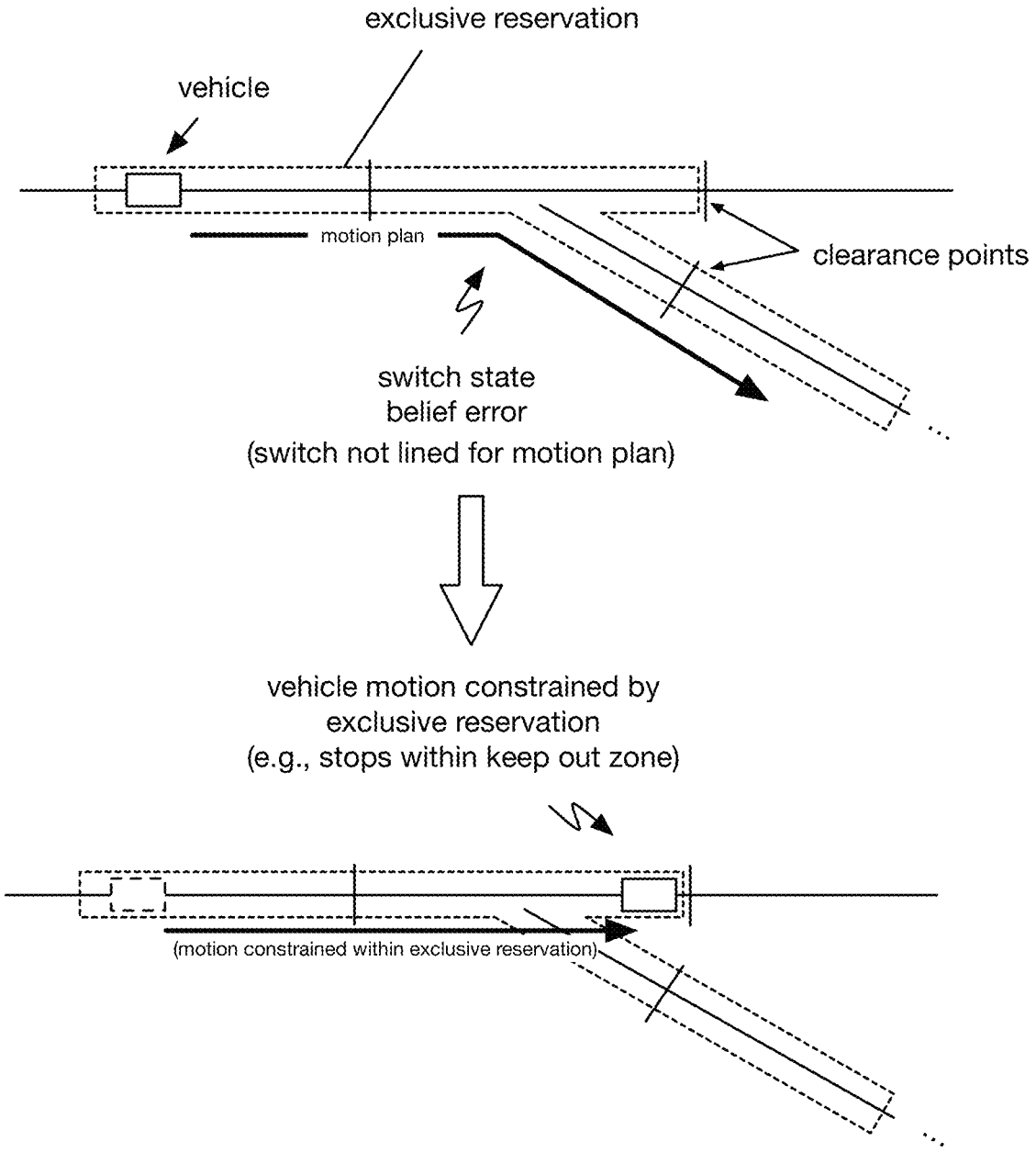
FIG. 6 is a flowchart diagrammatic example of a variant of the method.

In a first example, if the vehicle controller and/or motion planner detects that the vehicle has moved along the wrong track segment at a switch and/or otherwise detects an error in the belief of a switch state (e.g., CV-based detection, motion-based detection, etc.) and/or vehicle position, the vehicle remains constrained to stop within the existing reservation (e.g., an example is shown in FIG. 6) and no other vehicles will be able to traverse through the switch and/or reserved track segment(s) until the error is resolved and/or the reservation is released. In a second example, if the vehicle controller does not receive a heartbeat signal and/or an updated reservation (e.g., in the case of a communication failure, for example), the vehicle controller can stop the vehicle within the reserved region of track. Similarly, if the motion planner is unable to validate the communications from the vehicle controller, the vehicle dispatch system can directly control the vehicle to stop (e.g., via wireless communications) and/or indirectly control the vehicle to stop (e.g., restricting the vehicle by not issuing a superseding warrant which may be required for the vehicle to proceed).

Additionally or alternatively, the vehicle controller can function to distribute power and/or communications onboard the vehicle to affect vehicle control. The vehicle controller can additionally or alternatively function to implement autonomous navigation commands, teleoperation commands (e.g., received from a remote teleoperator), autonomous vehicle control (e.g., based on the set of operational parameters), and/or any other vehicle control. The controller is preferably onboard the vehicle (e.g., mounted to a vehicle chassis, etc.), but can alternatively be remote from the vehicle. The controller can be centralized (e.g., packaged within a single module) or distributed (e.g., across multiple compute nodes, packaged within multiple compute modules, etc.). The controller can receive sensory inputs/measurements from the sensor suite, which can be used to determine a vehicle state, dynamically control the vehicle, manage the batteries, and/or control the electric powertrain. The controller can include a battery management system which functions to monitor the state of the battery. The state of the battery can include: state of charge (SoC), state of health (SoH), state of power (SoP), state of safety (SoS), temperature (e.g., of the battery or a set of cells therein, of a working fluid, a temperature distribution of battery cells, etc.), and/or any other suitable characteristics. The battery management system can also function to control the charge and/or discharge of the battery. However, the controller can include any other suitable BMS. The controller can include one or more motor controllers which function to condition power from the battery to be supplied to a motor and/or to control electrical propulsion and/or dynamic (regenerative) braking at the motor. There can be a single motor controller associated with the vehicle, one motor controller per motor, and/or any other suitable number of motor controllers. However, the controller can include any other suitable motor controllers. In variants, the controller can function to facilitate vehicle transit and/or powertrain control as described in U.S. application Ser. No. 17/335,732, filed 1 Jun. 2021, which is incorporated herein in its entirety by this reference. In variants, the controller can control a platoon of electric vehicle(s) individually or may be used to control vehicles in a pairwise manner (e.g., via V2V communications, etc.).

In variants, a vehicle controller can include: a speed controller, velocity controller, PID controller, MPC controller, nonlinear controller, feedback controller, feedforward controller, and/or can implement any other suitable control schemes or any combination/permutation thereof.

However, the system can include any other suitable vehicle controller and/or operate in conjunction with any other suitable vehicle(s) or vehicle control scheme(s).

3.6 Switch Management

The switch management system functions to maintain state awareness of a switch(es) within the rail network and/or along a vehicle route. In variants, the switch management system can be integrated with the computing system of a motion planner (and/or can be integrated with the motion planner) and/or can be separate (e.g., implemented as a cloud service). The switch management system can be centralized, distributed, remote (e.g., relative to the motion planner), local (e.g., relative to the motion planner; cloud computing/storage; etc.), and/or can be otherwise suitably implemented. The switch management system can receive inputs and/or manages switch states based on: track data (e.g., aggregated by a map service; bulletins, track rules; etc.), user inputs (e.g., received via a UI and/or API associated therewith), train command and control state data (e.g., position data; track reservations; vehicle motion plans and/or commands; etc.), vehicle route data (e.g., from fleet management and/or user interface), infrastructure state data, and/or any other suitable data/information.

Figure 9:
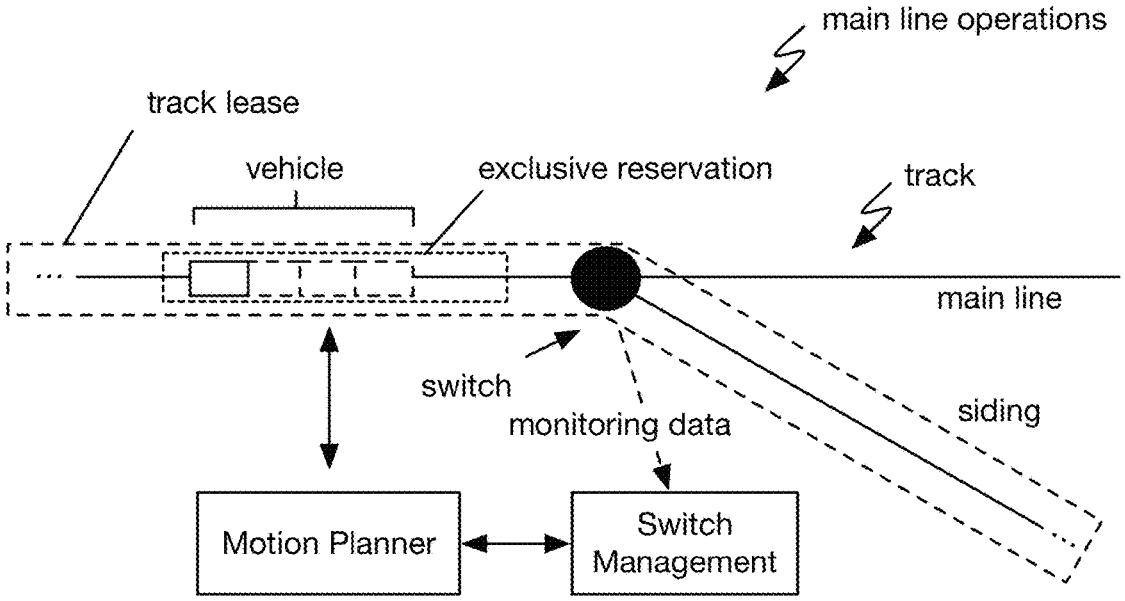
FIG. 9 is a diagrammatic representation of a variant of the system.

Switches within the rail network can include monitored switches 102 (e.g., with integrated monitoring; remotely controllable/actuatable by a switch operator; an example is shown in FIG. 9; etc.), unmonitored switches, manual switches (e.g., configured to be thrown by hand), power switches (e.g., automatically and/or remotely actuatable), and/or any other suitable type(s) of switches. For example, the switch management system can receive switch state inputs 104 from a set of monitored switches (e.g., wherein the monitored switches may be a small fraction of the total switches within the rail network, such as at key sidings or major junctions, etc.). Additionally or alternatively, the switch management system can receive switch state inputs (e.g., unmonitored switch data 152 associated with unmonitored switches) from a user interface and/or via an API associated with a user interface. In such variants, the switch management system can receive switch state/verification inputs from the UI determinations provided in substantially in real time (i.e., synchronous with vehicle operation and control; from an local operator or tele-operator) and/or based on asynchronous verifications (i.e., after a vehicle has vacated the switch and track between the switch clearance points the trailing camera footage can be reviewed for state verification, etc.), such as via the tele-operation platform. For example, the inputs to the switch state management system can be received from/via the system(s) and/or method(s) as described in U.S. application Ser. No. 18/514,946, filed 20 Nov. 2023.

The switch management system preferably maintains a belief state for the switch(es) within the network based on information provided by human operators (e.g., via the user interface and/or an API) and data collected from monitored switches. Additionally, the switch management system can optionally incorporate feedback from the vehicle controller (s), wherein a vehicle traversing through an unmonitored switch can be used to determine and/or validate the switch position (e.g., autonomous CV determinations, such as based on signals). The state for each switch is preferably associated with exactly one configuration/position of the switch (e.g., a possible alignment of the switch) which is selected from the predetermined set of possible switch configurations (e.g., forward, reverse; main-to-main, siding alignment; default, non-default, etc.; as defined by track map/geometry and/or managed by a map service). Additionally, in some variants a switch state can be characterized as 'unknown' (or null) in the case that insufficient data exists to render a determination (e.g., no data/information within a threshold time period, external authority grant for the switch intervening between current time and most recent data, etc.). For example, the state for a switch can be maintained by the switch management system and/or a database thereof for 10-30 minutes after the most recent data provision associated with from an operator and/or vehicle controller (e.g., 10-30 minutes after a vehicle has traversed through and/or released the reservation for a switch), after which the switch state may be reverted to 'unknown.' The switch state can be reverted to an unknown state or a default state (e.g., which may be specified by track rules) based on a set of rules/heuristics, based on track data (e.g., track bulletins, track conditions, etc.), an operator input via the user interface/API, an event trigger (e.g., satisfaction of an expiration parameter, etc.), and/or based on any other suitable determination(s). For example, the switch state may be held fixed based on the presence of a track reservation for the switch (and/or track coordinates between any of the switch clearance points and the switch junction) and/or at least one switch reservation (e.g., based on vehicle routing for the current switch alignment/state). Additionally or alternatively, switch states may revert to a default configuration (e.g., aligned main-to-main) in accordance with the track rules.

The switch states and/or switch reservations are preferably indexed (e.g., in associated with the switch, for a current map version) and stored within the switch management system (e.g., at a database, such as a local database/server, accessible by the motion planner, etc.). Additionally or alternatively, switches and/or switch reservations associated therewith can be indexed relative to the track geometry and/or globally indexed (e.g., based on waypoints, such as GPS switch coordinates) as track features independently of a map version/index, such as in accordance with the system (s) and/or method(s) as described in U.S. application Ser. No. 18/499,034, filed 31 Oct. 2023, which is incorporated herein in its entirety by this reference. The switch states can be stored for a finite duration (e.g., until an expiration condition is satisfied) and/or can be reverted to an unknown, null state or default state in response to satisfaction of trigger event (e.g., timer expiration, release of a reservation [s] held for the track and/or switch, etc.). However, the switch states can be otherwise suitably stored/indexed and/or the switch management system can be otherwise suitably maintained.

In a first set of variants, the switch management system can receive position data from each of a set of monitored switches (e.g., repeatedly, periodically, in response to a push and/or pull request, with any other suitable frequency/timing, etc.).

In a second set of variants, nonexclusive with the first, the switch management system can receive position data from a set of vehicle(s) in proximity to a switch(es) of the rail network. For example, a vehicle passing through a switch can be used to update the state estimate and/or an expiration time associated therewith.

In a third set of variants, nonexclusive with the first and second, the switch management system can receive switch states from a user interface and/or an API associated therewith. For example, a user can update the switch state via the UI in response to manually adjusting the switch state (e.g., via a tablet or other user device, while the user is on site at the switch). In a second example, a user can validate and/or adjust the switch position in response to a request from the motion planner and can provide the switch state to the switch management system via the UI.

In a fourth set of variants, nonexclusive with the first, second, and third, the switch management system can be updated based on vision-based observation of a switch. For example, an unknown switch state can be observed while a vehicle slowly approaches the switch and/or stops adjacent to the switch (e.g., within an existing authority grant). For instance, model-based computer vision and/or remote (tele-operator) monitoring by a human can be used to determine the state of an unmonitored switch. As an example, the switch state of an (unreserved) switch can be updated based on a switch state confirmation received from a remote tele-operation system based on manual analysis of a set of camera images associated with the switch (i.e., an unmonitored switch, where the images are captured by wayside track monitoring systems and/or a vehicle [s] operating within the rail network). Additionally or alternatively, switch states can be updated based on tele-operator analysis as described in U.S. application Ser. No. 18/514,946, filed 20 Nov. 2023, which is incorporated herein in its entirety by this reference.

Figure 7:
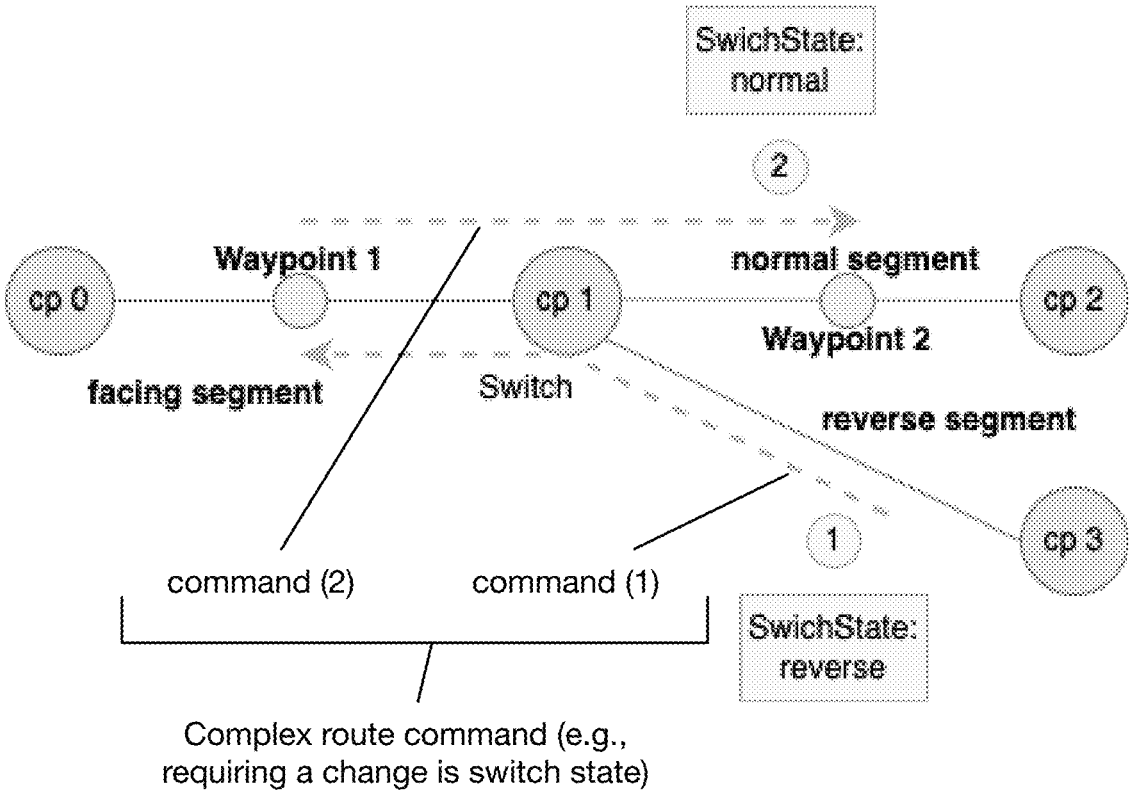
FIG. 7 is a schematic example of a complex routing involving a change in switch state.

In variants, the switch management system can manage updates to switch states based on a set of switch reservations. Switch reservations function to reserve switches for a particular vehicle and/or route, preventing users and/or other systems from modifying the switch position to facilitate execution of the route. Switch reservations can be indexed as waypoints, independently of track geometry and track coordinates), and/or relative to the track map (e.g., aggregated via the map data service). Switch reservations are preferably maintained for a particular vehicle and/or route until the vehicle clears the switch and/or a distal clearance point thereof, thus locking the switch in a target configuration specified for the route. The switch reservation can be released once the vehicle clears the switch (i.e., no track reservation held by the vehicle between switch clearance points; vehicle position clears distal clearance point, etc.), which may allow the alignment to be changed for other vehicles. Switch reservations are preferably independently managed by the switch management system in accordance with track rules/policies (e.g., as applied to switches). Switch reservations can be exclusive (e.g., exactly one train may reserve a switch at any given time; multiple exclusive reservations may be held by a train for a particular switch) and/or nonexclusive (e.g., multiple trains may contemporaneously reserve a switch). For instance, exclusive switch reservations may be necessary in some cases to facilitate execution of complex route commands (e.g., an example of which is shown in FIG. 7; which may require a change in switch state after release of a first exclusive reservation), such as described in U.S. application Ser. No. 18/609,832, filed 19 Mar. 2024, which is incorporated herein in its entirety by this reference. As an example, the switch management system may maintain exactly one unitary switch reservation for a switch in association with a complex route. Additionally or alternatively, nonexclusive switch reservations may be particularly advantageous in cases where multiple trains are following a similar vehicle route (e.g., which may be used to facilitate fleet level optimizations).

The switch management system preferably limits updates to the state of switches for which there is no reservation held (i.e., when there is no vehicle with active authority over the switch). Conversely, the switch management system may prohibit or restrict switch state updates for reserved switches, for which there is at least one extant reservation. For example, a user may not have permission to adjust/update the switch position (and/or switch state stored within a database of the switch management system). Similarly, the motion planner and/or switch management system may queue or otherwise delay requests for switch position changes to a switch while at least one reservation is held for the switch (e.g., reservations may be held for higher priority or closer proximity vehicles, for example). As a second example, switch states of reserved switches can be held constant by the switch management system while at least one corresponding switch reservation persists. The switch management system can include (or be used with) a database storing a switch state for each of the plurality of switches, the switch management system configured to: determine and maintain a set of switch reservations, each switch reservation associated with a respective switch of the plurality of switches, wherein the set of switch reservations defines, for the plurality of switches: a subset of reserved switches and remainder of unreserved switches, wherein each reserved switch is associated with at least one switch reservation; and update switch states for unreserved switches of the plurality of switches in the database (e.g., based on track rules for the track map, such as based on the default switch state for each switch). Additionally or alternatively, any inputs received from an operator (e.g., via an API), vehicle, and/or monitored switch which indicate a belief state error for a switch with at least one active switch reservation, the system can halt vehicle operations through the switch (e.g., via motion planning and/or fleet management), such as by preventing issuance of further heartbeat commands, track reservations, and/or switch reservations in proximity to the switch (i.e., between clearance points and/or at the junction).

Accordingly, switch reservations can be determined and/or maintained by the switch management system based on: track data (e.g., bulletins), train command and control state data (e.g., position data; track reservations; vehicle motion plans and/or commands; etc.), vehicle route data (e.g., from fleet management and/or user interface; fleet routing optimizations, etc.), and/or any other suitable data/information. In a first example, reservations can be determined (and maintained) based on the switch position matching a target alignment for a vehicle route(s) (e.g., of a proximal vehicle; ordered/prioritized by fleet routing/optimization; etc.). As second example, the system (e.g., motion planner and/or UI) may direct a user(s) to modify and/or confirm a switch state for an upcoming route segment based on the vehicle route (and/or motion plan); once the switch state is confirmed to match a target configuration for the vehicle route(s), the switch management system can determine a switch reservation and maintain the reservation until the vehicle(s) traversing along the vehicle route(s) vacate the switch. As a third example, switch states (e.g., of unreserved switches) and/or switch reservations can be updated based on track bulletins (e.g., received from a railroad authority; which may restrict access to certain regions of track, such as based on track maintenance, railroad emergencies, etc.).

Switch reservations are preferably maintained independently of track reservations. In such cases, switch reservations can facilitate route optimizations (e.g., partial ordering of fleet level routing; order of traversal in dense rail yards; etc.) and may not be safety critical in some cases (e.g., except where governed by track rules), while track reservations may be relied upon for PTC and collision avoidance (e.g., which may be safety critical, particularly for a partially or fully autonomous vehicle).

In one set of variants, the system can include a vehicle routing database comprising: automatically generated vehicle routing instructions (e.g., determined by the fleet management system) and manually assigned vehicle routing instructions (e.g., received via a user interface), wherein the switch management system is configured to determine switch reservations based on both the automatically generated vehicle routing instructions and manually assigned vehicle routing instructions. For example, the switch management system can simultaneously maintain a first switch reservation and a second switch reservation based on a first vehicle route and second vehicle route, respectively, the first vehicle route generated automatically, the second vehicle route received via a user interface, wherein the motion planner is configured to command traversal of a first vehicle, based on a first motion plan determined according to the first vehicle route, wherein the motion planner is configured to command traversal of a second vehicle, contemporaneously with traversal of the first vehicle, based on a second motion plan determined according to the second vehicle route.

In some variants, track rules may require that main line switches be returned to a default configuration (e.g., aligned main-to-main; upon release of an authority grant; etc.). In such cases, observation of the switch (e.g., via the camera) and/or traversal of the switch (e.g., periodically) by autonomous vehicles can be used to validate that the switch is positioned in the default configuration without direct involvement of an operator, which may facilitate subsequent traversal of the switch (e.g., at higher speed) based on the known state. Alternatively, a human operator (e.g., on site, remotely observing the camera feed, etc.) can be involved to validate an unknown configuration and/or to control/adjust the switch state as necessary (e.g., if the switch is not in the default configuration, etc.). In one example, diverting a vehicle to a siding may require an operator to manually revert the switch to a default configuration (e.g., main to main alignment) after the vehicle has exited to the siding. However, the operator may be restricted from adjusting the switch position and/or updating the switch state until the vehicle has vacated a reservation to the switch.

However, the system can include or be used in conjunction with any other suitable switch management system(s).

In variants, in conjunction with the switch management system, adjustments to switch states can optionally be directed/managed by a fleet management system, the motion planning system, and/or the user interface according to any suitable set of decision trees, heuristics, rules, and/or other decision schemes which respect the exclusivity requirements (e.g., only one exclusive reservation can exist for a switch at a given time; the vehicle may only proceed when the switch state is lined for the vehicle route; adjustments cannot be made to the switch state while the switch is reserved). Within these constraints, any suitable set of fleet management, vehicle prioritization, queuing, and/or other techniques may be employed to optimize rail traffic routing within the network. Alternatively, vehicles can be directed manually (e.g., via the user interface) while respecting the switch exclusivity requirements.

In variants, the motion planner preferably determines motion plan(s) associated with a target state of at least one switch of the plurality; determines/maintains exclusive track reservation(s) based on the switch state of the switch (i.e., as managed by the switch management system and/or as stored in/retrieved from a database) matching the target state; and command traversal of the rail vehicle(s) based on the exclusive track reservation(s) and the motion plan(s).

However, the system can include any other suitable components.

4. Example Process Flow

Figure 4:
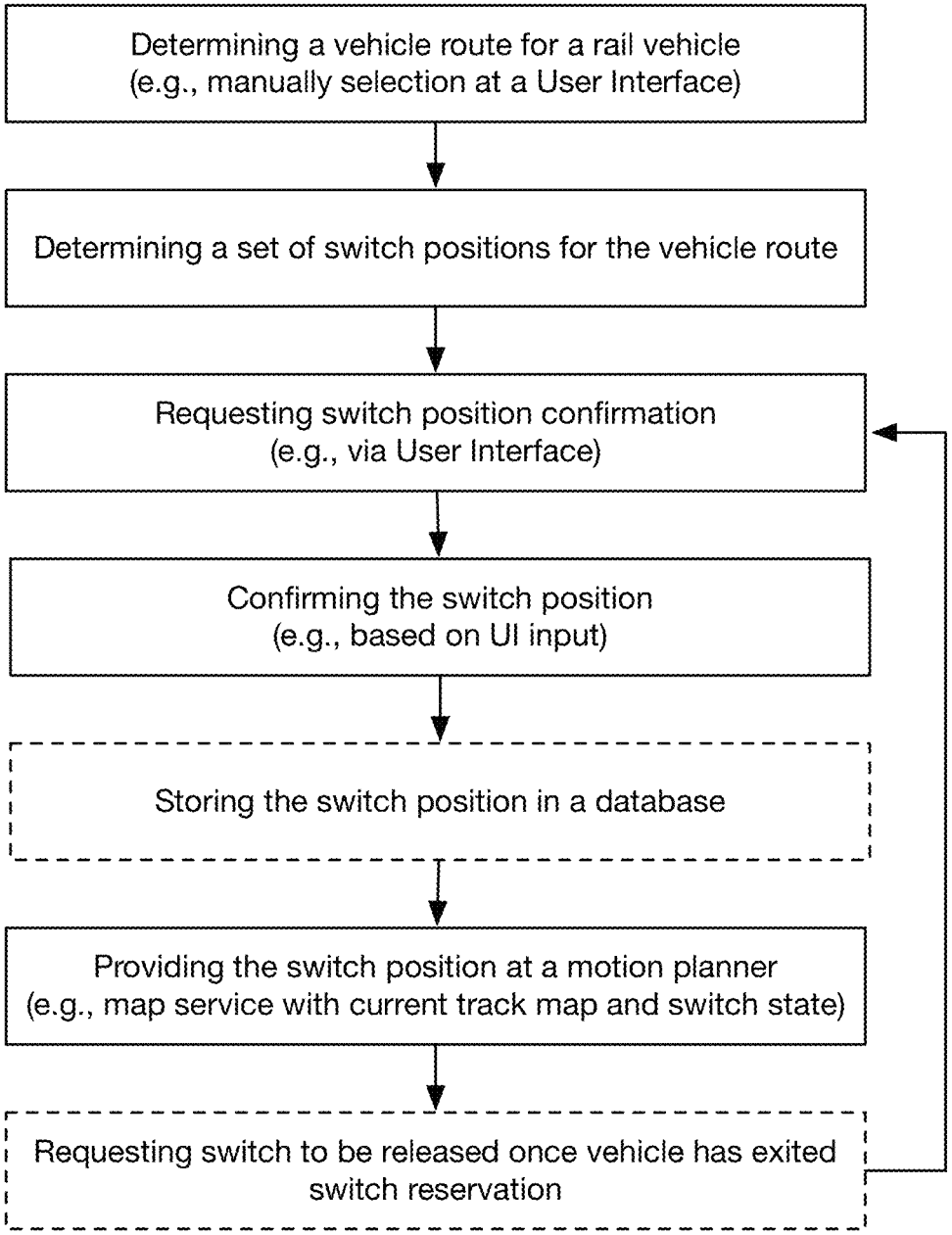
FIG. 4 is a flowchart diagram of a variant of the method.

In one set of variants (e.g., an example is shown in FIG. 4), a method for controlling traversal of an autonomous rail vehicle through a switch includes: determining a route for the autonomous rail vehicle, the route comprising a target switch configuration for the switch; determining satisfaction of a first trigger condition for the switch, and, in response, requesting confirmation of the target switch configuration for the switch; receiving confirmation of the target configuration for the switch; based on the confirmation of the target configuration, updating a switch database; based on the switch database, determining an exclusive track reservation for the autonomous rail vehicle, the exclusive track reservation comprising the switch; executing Positive Train Control (PTC) for the autonomous rail vehicle based on the exclusive track reservation; subsequently, releasing the exclusive track reservation based on a vehicle state of the autonomous rail vehicle; and based on satisfaction of a second trigger condition, updating the configuration of the switch in the switch database. The target configuration of the switch can be maintained within the switch database while the exclusive track reservation persists. The method can further include: after receiving confirmation of the target configuration, determining a first switch reservation of the switch for traversal of the autonomous rail vehicle on the route. For example, the second trigger condition can include a termination of a second switch reservation of the switch, the second switch reservation associated with a second vehicle traversing along a second route, the second route comprising the target switch configuration for the switch. As a second example, the second trigger condition can include a release of the first switch reservation, wherein updating the configuration of the switch in the switch database comprises automatically setting the switch to a default state according to a predetermined set of track rules in response to the satisfaction of the second trigger condition. However, the switch management system can facilitate any other suitable method(s) of operation and/or can operate in conjunction with any other suitable process(es).

Alternative embodiments implement the above methods and/or processing modules in non-transitory computer-readable media, storing computer-readable instructions. The instructions can be executed by computer-executable components integrated with the computer-readable medium and/or processing system. The computer-readable medium may include any suitable computer readable media such as RAMs, ROMs, flash memory, EEPROMs, optical devices (CD or DVD), hard drives, floppy drives, non-transitory computer readable media, or any suitable device. The computer-executable component can include a computing system and/or processing system (e.g., including one or more collocated or distributed, remote or local processors) connected to the non-transitory computer-readable medium, such as CPUs, GPUs, TPUS, microprocessors, or ASICs, but the instructions can alternatively or additionally be executed by any suitable dedicated hardware device.

Embodiments of the system and/or method can include every combination and permutation of the various system components and the various method processes, wherein one or more instances of the method and/or processes described herein can be performed asynchronously (e.g., sequentially), concurrently (e.g., in parallel), or in any other suitable order by and/or using one or more instances of the systems, elements, and/or entities described herein.

As a person skilled in the art will recognize from the previous detailed description and from the figures and claims, modifications and changes can be made to the preferred embodiments of the invention without departing from the scope of this invention defined in the following claims.

We claim:

1. A system for a rail network, the rail network comprising a plurality of switches and defining a track map, the system comprising:

a switch management system comprising a database storing a switch state for each of the plurality of switches, the switch management system configured to:

determine and maintain a set of switch reservations, each switch reservation associated with a respective switch of the plurality of switches, wherein the set of switch reservations defines, for the plurality of switches: a subset of reserved switches and remainder of unreserved switches, wherein each reserved switch is associated with at least one switch reservation; and based on track rules for the track map, update switch states for unreserved switches of the plurality of switches in the database;

a motion planner communicatively coupled to a plurality of rail vehicles and the database, the motion planner configured to, for each rail vehicle of the plurality:

determine a motion plan associated with a target state of a switch of the plurality;

based on the switch state of the switch, stored in the database, matching the target state, determine and maintain an exclusive track reservation defined relative to track coordinates of the track map; and command traversal of the rail vehicle based on the exclusive track reservation and the motion plan.

2. The system of claim 1, wherein each rail vehicle of the plurality is configured to be autonomously controlled, by an onboard vehicle controller of the rail vehicle, within track coordinates of the exclusive track reservation.

3. The system of claim 1, wherein the switch reservations are nonexclusive.

4. The system of claim 3, wherein the exclusive track reservations and the switch reservations are independently maintained.

5. The system of claim 4, wherein switch states of reserved switches are held constant by the switch management system while the at least one switch reservation persists.

6. The system of claim 3, further comprising a vehicle routing database comprising: automatically generated vehicle routing instructions and manually assigned vehicle routing instructions received via a user interface, wherein the switch management system is configured to determine switch reservations based on both the automatically generated vehicle routing instructions and manually assigned vehicle routing instructions.

7. The system of claim 3, wherein the switch management system simultaneously maintains a first switch reservation and a second switch reservation based on a first vehicle route and second vehicle route, respectively, the first vehicle route generated automatically, the second vehicle route received via a user interface, wherein the motion planner is configured to command traversal of a first vehicle, based on a first motion plan determined according to the first vehicle route, wherein the motion planner is configured to command traversal of a second vehicle, contemporaneously with traversal of the first vehicle, based on a second motion plan determined according to the second vehicle route.

8. The system of claim 1, wherein the switch reservations are maintained based on the motion plans for each vehicle of the plurality.

9. The system of claim 1, wherein the respective motion plans and the respective switch reservations are determined based on vehicle routes received from a fleet management system, wherein a respective vehicle route for a first vehicle of the plurality comprises a complex vehicle route which crosses a first switch twice with under two distinct switch states.

10. The system of claim 9, wherein the switch management system maintains a unitary switch reservation for the first switch in association with the complex route of the first vehicle.

11. The system of claim 1, further comprising: a fleet management system configured to optimize respective vehicle routes, comprising a respective series of switches, for vehicles within the rail network, wherein the series of switches is received by the motion planner from the fleet management system.

12. The system of claim 1, wherein the switch states for unreserved switches of the plurality are updated based on a set of inputs comprising a switch state confirmation received from a remote tele-operation system based on manual analysis of a set of camera images associated with an unmonitored switch.

13. The system of claim 1, wherein the switch states for unreserved switches of the plurality are updated based on a set of inputs comprising a set of exclusive track reservations managed by the motion planner.

14. The system of claim 1, wherein the switch states for unreserved switches of the plurality are updated based on a set of inputs comprising a track bulletin.

15. The system of claim 1, wherein the switch reservations are defined independently of track coordinates of the track map.

16. A method for controlling traversal of an autonomous rail vehicle through an unmonitored switch, the method comprising:

determining a route for the autonomous rail vehicle, the route comprising a target switch configuration for the unmonitored switch;

determining satisfaction of a first trigger condition for the unmonitored switch, and, in response, requesting confirmation of the target switch configuration for the unmonitored switch;

receiving confirmation of the target configuration for the unmonitored switch;

based on the confirmation of the target configuration, updating a switch database;

based on the switch database, determining an exclusive track reservation for the autonomous rail vehicle, the exclusive track reservation comprising the unmonitored switch;

executing Positive Train Control (PTC) for the autonomous rail vehicle based on the exclusive track reservation;

subsequently, releasing the exclusive track reservation based on a vehicle state of the autonomous rail vehicle; and based on satisfaction of a second trigger condition, updating the configuration of the unmonitored switch in the switch database.

17. The method of claim 16, further comprising: after receiving confirmation of the target configuration, determining a first switch reservation of the unmonitored switch for traversal of the autonomous rail vehicle on the route.

18. The method of claim 17, wherein the second trigger condition comprises a termination of a second switch reservation of the unmonitored switch, the second switch reservation associated with a second vehicle traversing along a second route, the second route comprising the target switch configuration for the unmonitored switch.

19. The method of claim 17, wherein the second trigger condition comprises a release of the first switch reservation, wherein updating the configuration of the unmonitored switch in the switch database comprises automatically setting the unmonitored switch to a default state according to a predetermined set of track rules in response to the satisfaction of the second trigger condition.

20. The method of claim 16, wherein the target configuration of the unmonitored switch is maintained within the switch database while the exclusive track reservation persists.

* * * * *